US009039241B2

(12) United States Patent
Kinnune et al.

(10) Patent No.: US 9,039,241 B2
(45) Date of Patent: May 26, 2015

(54) LED LIGHT FIXTURE

(71) Applicant: Cree, Inc., Durham, NC (US)

(72) Inventors: Brian Kinnune, Racine, WI (US); Alan J. Ruud, Racine, WI (US); Kurt Wilcox, Libertyville, IL (US); Don Miletich, Franklin, WI (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/087,971

(22) Filed: Nov. 22, 2013

(65) Prior Publication Data

US 2014/0078740 A1 Mar. 20, 2014

Related U.S. Application Data

(63) Continuation of application No. 13/680,481, filed on Nov. 19, 2012, now Pat. No. 8,622,584, which is a continuation of application No. 13/333,198, filed on Dec. 21, 2011, now Pat. No. 8,313,222, which is a (Continued)

(51) Int. Cl.
*F21V 29/00* (2006.01)
*F21V 15/01* (2006.01)
(Continued)

(52) U.S. Cl.
CPC ..... *F21V 15/011* (2013.01); *F21S 2/005* (2013.01); *F21V 15/013* (2013.01);
(Continued)

(58) Field of Classification Search
CPC ... F21V 15/00; F21V 29/2293; F21V 29/004; F21K 9/30
USPC ..... 362/218, 294, 373
See application file for complete search history.

(56) References Cited

U.S. PATENT DOCUMENTS 3,860,829 A 1/1975 Fabbri et al.
4,071,749 A 1/1978 Balogh
(Continued)

FOREIGN PATENT DOCUMENTS

CN 101093073 A 12/2007
CN 101101102 A 1/2008
(Continued)

OTHER PUBLICATIONS

"Miscellaneous Shape Heat Sinks," brochure excerpt. National Northeast Corporation, Pelham, NH. Undated.
(Continued)

*Primary Examiner* — David V Bruce
(74) *Attorney, Agent, or Firm* — Jansson Munger McKinley and Shape Ltd.

(57) ABSTRACT

An LED light fixture a housing, a heat sink secured with respect to the housing, the heat sink has a base with front and back surfaces, and an LED arrangement mounted at the front surface of the heat sink The back surface of the heat sink is open to water/air flow thereover. The LED light fixture also includes at least one closed channel extending along the base and spaced therefrom for receiving wire connections for the LED arrangement. The at least one closed channel receives wiring extending to/from the second LED module. The LED arrangement may include at least first and second LED modules, the first LED module being proximal to the housing with the at least one closed channel receiving wiring extending to/from the second LED module. The first and second LED modules may be in end-to-end relationship to one another such that the second LED module is distal from the housing.

19 Claims, 20 Drawing Sheets

Related U.S. Application Data continuation of application No. 12/418,364, filed on Apr. 3, 2009, now Pat. No. 8,092,049.

(60) Provisional application No. 61/042,690, filed on Apr. 4, 2008.

(51) Int. Cl.

| | |
|---|---|
| ***F21V 15/015*** | (2006.01) |
| ***F21V 17/10*** | (2006.01) |
| ***F21V 19/00*** | (2006.01) |
| ***F21V 23/00*** | (2006.01) |
| ***F21V 31/03*** | (2006.01) |
| ***F21V 19/04*** | (2006.01) |
| ***F21K 99/00*** | (2010.01) |
| *F21S 2/00* | (2006.01) |
| *F21W 131/103* | (2006.01) |
| *F21Y 101/02* | (2006.01) |
| *F21Y 105/00* | (2006.01) |
| *F21S 8/08* | (2006.01) |

(52) U.S. Cl.

CPC ..... *F21V 15/015* (2013.01); *F21V 17/107* (2013.01); *F21V 19/0055* (2013.01); *F21V 23/002* (2013.01); *F21V 29/004* (2013.01); *F21V 29/2206* (2013.01); *F21V 29/225* (2013.01); *F21V 29/2262* (2013.01); *F21V 29/2293* (2013.01); *F21V 31/03* (2013.01); *F21W 2131/103* (2013.01); *F21Y 2101/02* (2013.01); *F21Y 2105/001* (2013.01); *F21V 19/045* (2013.01); *F21K 9/00* (2013.01); *F21S 8/086* (2013.01)

(56) References Cited

U.S. PATENT DOCUMENTS

| | | | |
|---|---|---|---|
| 4,156,891 | A | 5/1979 | Roche |
| 5,004,953 | A | 4/1991 | McDonald |
| 5,303,124 | A | 4/1994 | Wrobel et al. |
| 5,633,564 | A | 5/1997 | Edwards et al. |
| 5,676,455 | A | 10/1997 | Johnson et al. |
| 5,909,062 | A | 6/1999 | Krietzman |
| 5,988,829 | A | 11/1999 | Holder et al. |
| 6,045,232 | A | 4/2000 | Buckmaster et al. |
| 6,522,263 | B2 | 2/2003 | Jones |
| 6,565,238 | B1 | 5/2003 | Pyrtle |
| 6,648,496 | B1 | 11/2003 | Elghoroury et al. |
| 6,657,862 | B2 | 12/2003 | Crocker et al. |
| 6,784,351 | B2 | 8/2004 | Hauptmann et al. |
| 6,784,357 | B1 | 8/2004 | Wang |
| 6,815,724 | B2 | 11/2004 | Dry |
| 6,957,905 | B1 | 10/2005 | Pritchard et al. |
| 7,036,961 | B2 | 5/2006 | Defouw et al. |
| 7,090,370 | B2 | 8/2006 | Clark et al. |
| 7,114,830 | B2 | 10/2006 | Robertson et al. |
| 7,153,004 | B2 | 12/2006 | Galli |
| 7,178,941 | B2 | 2/2007 | Roberge et al. |
| 7,199,529 | B2 | 4/2007 | Vernon-Dier |
| 7,234,844 | B2 | 6/2007 | Bolta et al. |
| 7,244,042 | B1 | 7/2007 | Bieberdorf |
| D551,379 | S | 9/2007 | Maxik |
| 7,267,459 | B2 | 9/2007 | Matheson |
| 7,278,761 | B2 | 10/2007 | Kuan |
| 7,303,301 | B2 | 12/2007 | Koren et al. |
| 7,503,669 | B2 | 3/2009 | Rizkin et al. |
| 7,513,639 | B2 | 4/2009 | Wang |
| 7,771,087 | B2 | 8/2010 | Wilcox et al. |
| 8,092,049 | B2 | 1/2012 | Kinnune et al. |
| 8,313,222 | B2 | 11/2012 | Kinnune et al. |
| 8,425,071 | B2 | 4/2013 | Ruud et al. |
| 8,622,584 | B2 | 1/2014 | Kinnune et al. |
| 2003/0048608 | A1 | 3/2003 | Crocker et al. |
| 2004/0036629 | A1 | 2/2004 | Jones et al. |
| 2004/0257006 | A1 | 12/2004 | Beeman et al. |
| 2005/0128752 | A1 | 6/2005 | Ewington et al. |
| 2005/0174762 | A1 | 8/2005 | Fogerlie |
| 2006/0250803 | A1 | 11/2006 | Chen |
| 2007/0086196 | A1 | 4/2007 | Wong |
| 2007/0115666 | A1 | 5/2007 | Thomas et al. |
| 2008/0037239 | A1 | 2/2008 | Thomas et al. |
| 2008/0080189 | A1 | 4/2008 | Wang |
| 2008/0080196 | A1 | 4/2008 | Ruud et al. |
| 2009/0268477 | A1 | 10/2009 | Zheng et al. |

FOREIGN PATENT DOCUMENTS

| | | | |
|---|---|---|---|
| CN | 101101103 | A | 1/2008 |
| CN | 101101104 | A | 1/2008 |
| CN | 101101106 | A | 1/2008 |
| CN | 101101107 | A | 1/2008 |
| CN | 101105268 | A | 1/2008 |
| CN | 101105278 | A | 1/2008 |
| EP | 1431653 | A2 | 6/2004 |
| EP | 1760393 | A1 | 3/2007 |
| EP | 1906081 | A1 | 4/2008 |
| WO | 9833007 | A1 | 7/1998 |
| WO | 9957945 | A1 | 11/1999 |
| WO | 0216826 | A1 | 2/2002 |
| WO | 03089841 | A1 | 10/2003 |
| WO | 2006060905 | A1 | 6/2006 |

OTHER PUBLICATIONS

Stanley Electric Co., Ltd. "Stanley LED for Street Light", brochure. Date: Aug. 2006.

"LED Light Sources" product description. Aavid Thermalloy. Date: Copyright 2006.

LED LIGHT FIXTURE

RELATED APPLICATION

This application is a continuation of patent application Ser. No. 13/680,481, filed Nov. 19, 2012, which is a continuation of patent application Ser. No. 13/333,198, filed Dec. 21, 2011, now U.S. Pat. No. 8,313,222, issued Nov. 20, 2012, which is a continuation of patent application Ser. No. 12/418,364, filed Apr. 3, 2009, now U.S. Pat. No. 8,092,049, issued Jan. 10, 2012, which is based in part on U.S. Provisional Application Ser. No. 61/042,690, filed Apr. 4, 2008. The entirety of the contents of each of the above-listed applications are incorporated herein by reference.

FIELD OF THE INVENTION

This invention relates to light fixtures and, more particularly, to street and roadway light fixtures and the like, including light fixtures for illumination of large areas. More particularly, this invention relates to such light fixtures which utilize LEDs as light source.

BACKGROUND OF THE INVENTION

In recent years, the use of light-emitting diodes (LEDs) for various common lighting purposes has increased, and this trend has accelerated as advances have been made in LEDs and in LED-array bearing devices, often referred to as "LED modules." Indeed, lighting applications which have been served by fixtures using high-intensity discharge (HID) lamps and other light sources are now increasingly beginning to be served by LED modules. Such lighting applications include, among a good many others, roadway lighting, parking lot lighting and factory lighting. Creative work continues in the field of LED module development, and also in the field of using LED modules for light fixtures in various applications. It is the latter field to which this invention relates.

High-luminance light fixtures using LED modules as light source for roadway and similar applications present particularly challenging problems. High costs due to high complexity becomes a particularly difficult problem when high luminance, reliability, and durability are essential to product success. Keeping electronic LED drivers in a water/air-tight location may also be problematic, particularly when, as with roadway lights and the like, the light fixtures are constantly exposed to the elements and many LED modules are used.

Yet another cost-related challenge is the problem of achieving a high level of adaptability in order to meet a wide variety of different luminance requirements. That is, providing a fixture which can be adapted to give significantly greater or lesser amounts of luminance as deemed appropriate for particular applications is a difficult problem. Light-fixture adaptability is an important goal for LED light fixtures.

Dealing with heat dissipation requirements is still another problem area for high-luminance LED light fixtures. Heat dissipation is difficult in part because high-luminance LED light fixtures typically have a great many LEDs and several LED modules. Complex structures for module mounting and heat dissipation have sometimes been deemed necessary, and all of this adds to complexity and cost.

In short, there is a significant need in the lighting industry for improved roadway light fixtures and the like using LEDs. There is a need for fixtures that are adaptable for a wide variety of lighting situations, and that satisfy the problems associated with heat dissipation and appropriate protection of electronic LED driver components. Finally, there is a need for an improved LED-module-based light which is simple, and is easy and inexpensive to manufacture.

OBJECTS OF THE INVENTION

It is an object of the invention to provide an improved LED light fixture that overcomes some of the problems and shortcomings of the prior art, including those referred to above.

Another object of the invention is to provide an improved LED light fixture that reduces development and manufacturing costs for LED light for applications requiring widely different luminance levels.

Another object of the invention is to provide an improved high-luminance LED light fixture with excellent reliability and durability, despite use in difficult outdoor environments.

Still another object of the invention is to provide an improved LED light fixture achieving excellent heat dissipation yet involving minimal structural complexity.

How these and other objects are accomplished will become apparent from the following descriptions and the drawings.

SUMMARY OF THE INVENTION

The owner of the present invention also owns a U.S. patent application Ser. No. 11/860,887 which discloses an LED Floodlight Fixture that deals with some of the problems and shortcomings of the prior art.

The present invention is an improvement in LED light fixtures, particularly for street and roadway lights and the like.

The inventive LED light fixture includes a housing that itself includes at least one end-portion and a single-piece extrusion secured with respect to the end-portion. The single-piece extrusion, which preferably is of aluminum or a similar metal or metal alloy, includes a base having an LED-adjacent surface, an opposite surface and a heat-dissipating section having heat-dissipating surfaces extending from the opposite surface. The inventive light fixture further includes an LED arrangement mounted to the LED-adjacent surface in non-water/air-tight condition with respect to the housing.

In a highly preferred embodiment of the inventive light fixture, the housing forms at least one venting gap between the at least one end-portion and the single-piece extrusion to provide cool-air ingress to and along the heat-dissipating surfaces by upward flow of heated air therefrom.

In some preferred embodiments the at least one end-portion preferably includes a first end-portion which forms a water/air-tight chamber enclosing at least one electronic LED driver and/or other electronics needed for LEDs.

Some highly preferred embodiments of the invention include a second end-portion. The single-piece extrusion includes first and second ends with the first and second end-portions secured with respect to the first and second ends, respectively, of the extrusion. It is preferred that such embodiments include a venting gap between each end-portion and the single-piece extrusion. In such embodiments, the second end-portion forms an endcap.

The first end-portion at the first end of the extrusion has a lower surface and an extrusion-adjacent end surface. In highly preferred embodiments of the inventive LED light fixture, the extrusion-adjacent end surface and the lower surface form a first recess extending away from the first end of the extrusion and defining a first venting gap. The end surface along the first recess is preferably tapered such that the first venting gap is upwardly narrowed, thereby to direct and accelerate the air flow along the heat-dissipating surfaces.

In such highly preferred embodiments of the invention, the endcap at the second end of the extrusion has an inner surface and a lower edge-portion. It is further highly preferred that the inner surface and the lower edge-portion of the endcap form a second recess extending away from the second end of the extrusion and defining a second venting gap. The inner surface along the second recess is preferably tapered such that the second venting gap is upwardly narrowed, thereby to direct and accelerate the air flow along the heat-dissipating surfaces.

In preferred embodiments of this invention, the LED arrangement includes at least one LED-array module. The LED arrangement most preferably includes a plurality of LED-array modules. The LED-array modules are preferably substantially rectangular elongate modules. Examples of LED-array modules are disclosed in co-pending U.S. patent application Ser. No. 11/774,422, the contents of which are incorporated herein by reference.

In preferred embodiments, the LED-array modules each have a common module-width, and the LED-adjacent surface of the base of the extrusion preferably has a width which is approximately the multiple of the maximum number of LED-array modules mountable in side-by-side relationship thereon by the common module-width. For example, if the maximum number of such modules side-by-side of the LED adjacent surface is three, the width of the LED-adjacent surface is about three times the module-width.

The LED-array modules further have predetermined module-lengths preferably associated with the numbers of LEDs on the modules. In other words, if a module has 20 LED thereon it will have one predetermined module-length, and if it has 10 LEDs thereon it will have a shorter predetermined module-length. It is preferred that the LED-adjacent surface has a length which is preferably approximately a dimension selected from the predetermined module-lengths and the sum(s) of the module-lengths of pairs of the LED-array modules. In some of the highly preferred embodiments, at least one of the plurality of modules has a module-length different than the module-length of at least another of the plurality of modules. The LED-adjacent surface is preferably selected to have a dimension that approximately corresponds to a length of the LED arrangement.

The light fixture of this invention and its single-piece extrusion can easily be adapted in a wide variety of ways to satisfy a great variety of luminance requirements.

In certain of the preferred embodiments, the plurality of LED-array modules includes LED-array modules in end-to-end relationship to one another. Such modules include modules proximal to the first end-portion and modules distal from the first end-portion. The first end-portion has water/air-tight wire-access(es) receiving wires from the proximal module(s).

In certain highly preferred embodiments, the extrusion includes water/air-tight wireway(s) receiving wires from the distal LED-array module(s), such that wires from the distal modules reach the water/air-tight chamber of the first end-portion through the wireway(s). The wireway(s) preferably extend through the heat-dissipating along the extrusion and spaced from the base. The heat-dissipating section preferably includes parallel fins along the lengths of the single-piece extrusion. The closed wireway(s) preferably extend(s) along the fin(s).

The wireway may be an enclosed tube secured with respect to the fin. Such fin preferably forms an extruded retention channel securely retaining the wireway tube therein. The wireway tube may be a jacketed cord, a separate aluminum tube or other suitable water/air-tight enclosure for wires to be passed from the distal modules to the water/air-tight chamber. The extruded retention channel may have an open "C" shape with an opening being smaller than the inner diameter such that the wireway tube may be secured with respect to the fin by snap fitting or sliding the wireway tube inside the retention channel.

In highly preferred embodiments in which the LED arrangement includes a plurality of LED-array modules, it is highly preferred that the base of the single-piece extrusion have at least one venting aperture therethrough to provide cool-air ingress to and along the heat-dissipating surfaces by upward flow of heated air therefrom.

The venting apertures preferably include at least one elongate aperture across at least a majority of the width of the base. It is preferred that a deflector member be secured to the base along the elongate aperture. The deflector member has at least one beveled deflector surface oriented to direct and accelerate air flow along the heat-dissipating surfaces. In some preferred embodiments, the deflector member includes a pair of oppositely-facing beveled deflector surfaces oriented to direct and accelerate air flow in opposite directions along the heat-dissipating surfaces—i.e., along heat-dissipating surface above the different modules.

In some of such embodiments, the plurality of LED-array modules preferably include LED-array modules in lengthwise relationship to one another. The venting aperture(s) include at least one aperture distal from (i.e., away from) the first and second ends of the extrusion—an aperture in a more or less middle position.

In some of such embodiments, the plurality of LED-array modules further includes at least one (and preferably two or more) proximal LED-array module(s) proximal to the first end of the extrusion and at least one (and preferably two or more) distal LED-array module(s) distal from the first end of the extrusion. The distal LED-array module(s) are preferably spaced from the proximal LED-array module(s). The venting aperture(s) distal from the first and second ends of the extrusion are preferably at the space between the proximal and distal LED-array modules.

In the highly preferred embodiments just described, the LED-adjacent surface has a length which is approximately a dimension that is (a) the sum of the module-lengths of pairs of the end-to-end LED-array modules plus (b) the length of the space between the proximal and distal LED-array modules. Most preferably, in such embodiments the LED-adjacent surface further has a width which is approximately the multiple of the maximum number of LED-array modules mountable in side-by-side relationship thereon by the common module-width.

In describing LED-array modules herein which are of generally rectangular configuration, the term "end" refers to the two opposite edges having the shortest dimension of such rectangular configuration, and the term "side" refers to the other two opposite edges, which typically have the longest dimension of such rectangular configuration (although a rectangular configuration which is square would, of course, have four edges of equal dimension).

The term "common module-width," as used herein with reference to rectangular LED-array modules, means that each of the LED-array modules mounted to the LED-adjacent surface has substantially the same width as the other modules. The term "widthwise," as used with respect to the mounting relationship of rectangular LED-array modules, means that each of such modules is positioned in a sideways direction from the other module(s), with or without space therebetween.

The term "side-by-side," as used with respect to the mounting relationship of rectangular LED-array modules, refers to a widthwise mounting relationship in which the modules are positioned with their sides substantially immediately adjacent to one another, regardless of whether they are in full-length side-by-side relationship.

The term "full-length side-by-side," as used herein with respect to the mounting relationship of LED-array modules, refers to a widthwise, side-by-side mounting relationship in which the full length of a module is positioned adjacent to the full length(s) of the other module(s).

The term "lengthwise," as used with respect to the mounting relationship of rectangular LED-array modules, means that each of such modules is positioned in an endwise direction from the other module(s), with or without space therebetween.

The term "end-to-end," as used with respect to the mounting relationship of rectangular LED-array modules, refers to an endwise mounting relationship in which the modules are positioned with their ends substantially immediately adjacent to one another, regardless of whether they are in full-width end-to-end relationship.

The term "full-width end-to-end," as used herein with respect to the mounting relationship of LED-array modules, refers to an endwise, end-to-end mounting relationship in which the full width of a module is positioned adjacent to the full width(s) of the other module(s).

DETAILED DESCRIPTION OF PREFERRED EMBODIMENTS

Figure 1:
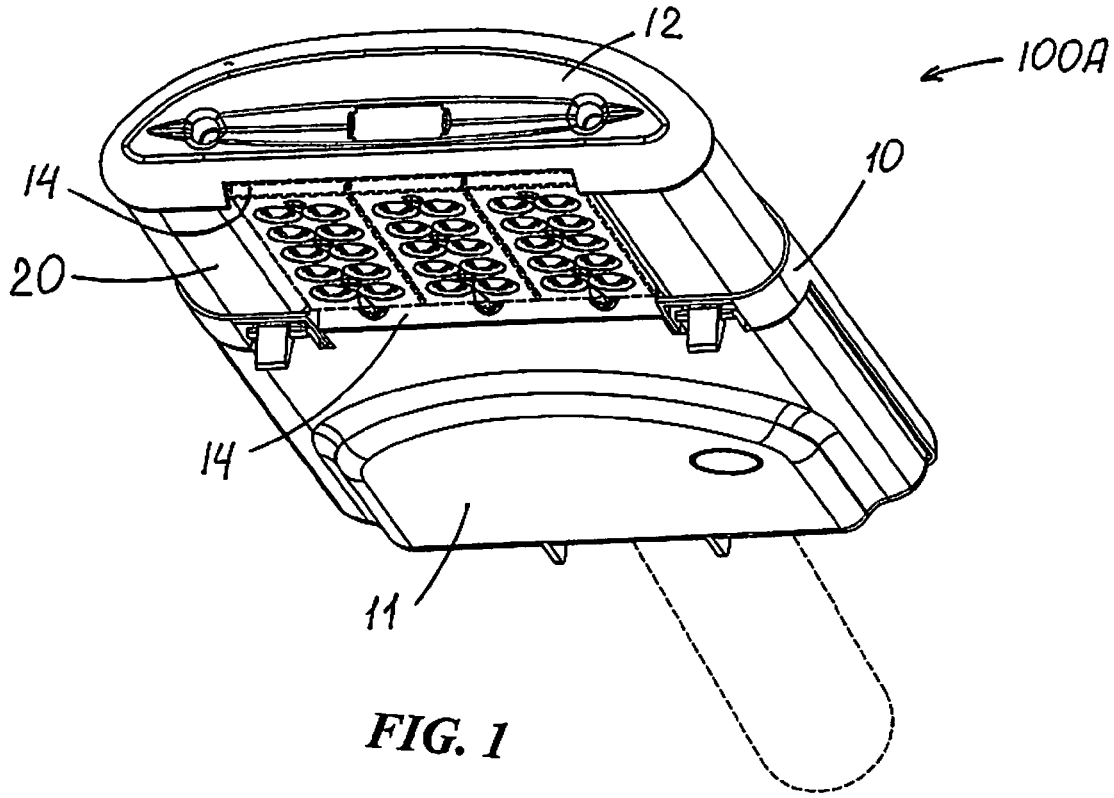
FIG. 1 is a perspective view from below of one embodiment of an LED light fixture in accordance with this invention including LED-array modules with ten LEDs thereon.
Figure 2:
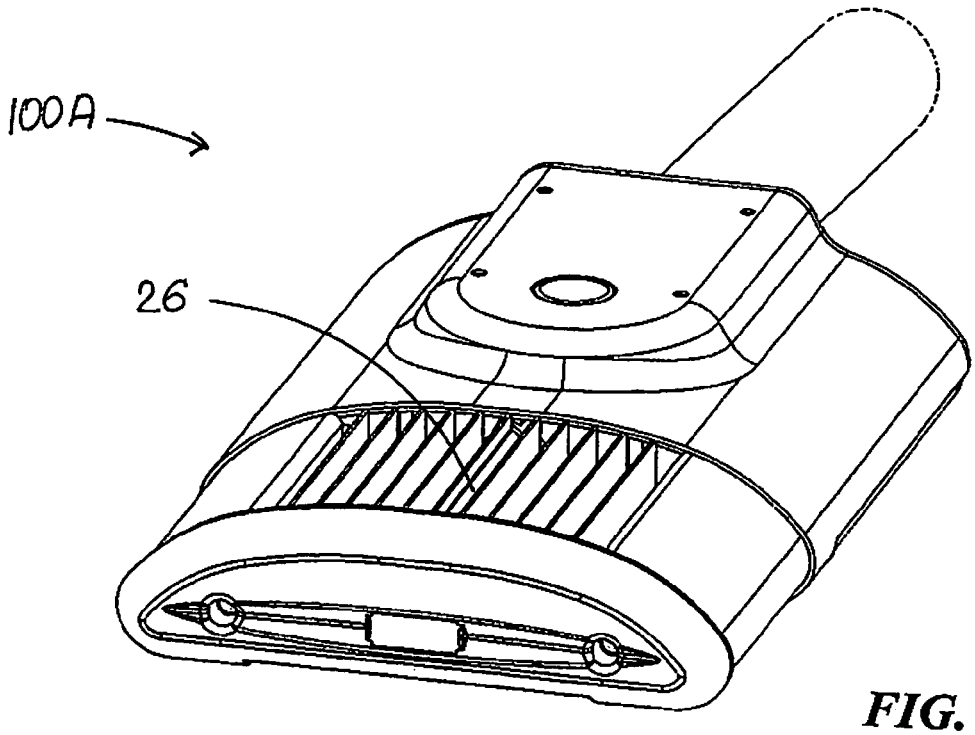
FIG. 2 is a perspective view from above of the LED light fixture of FIG. 1.

FIGS. 1-41 illustrate preferred embodiments of the LED light fixture 100A-100E in accordance with this invention. Common or similar parts are given same numbers in the drawings of all embodiments, and the floodlight fixtures are often referred to by the numeral 100, without the A or E lettering used in the drawings, and in the singular for convenience.

Floodlight fixture 100 includes a housing 10 that has a first end-portion 11 and a second end-portion 12 and a single-piece extrusion 20 that has first and second ends 201 and 202, respectively, with first and second end-portions 11 and 12 secured with respect to first and second ends 201 and 202, respectively. Single-piece extrusion 20 includes a substantially planar base 22 extending between first and second ends 201 and 202. Base 22 has an LED-adjacent surface 220 and an opposite surface 221. Single-piece extrusion 20 further has a heat-dissipating section 24 having heat-dissipating surfaces 241 extending from opposite surface 221. Light fixture 100 further includes an LED arrangement 30 mounted to LED-adjacent surface 220 in non-water/air-tight condition with respect to housing 10. (See FIGS. 1, 3, 7, 12-31) In these embodiments, second end portion 12 forms an endcap 120.

Figure 7:
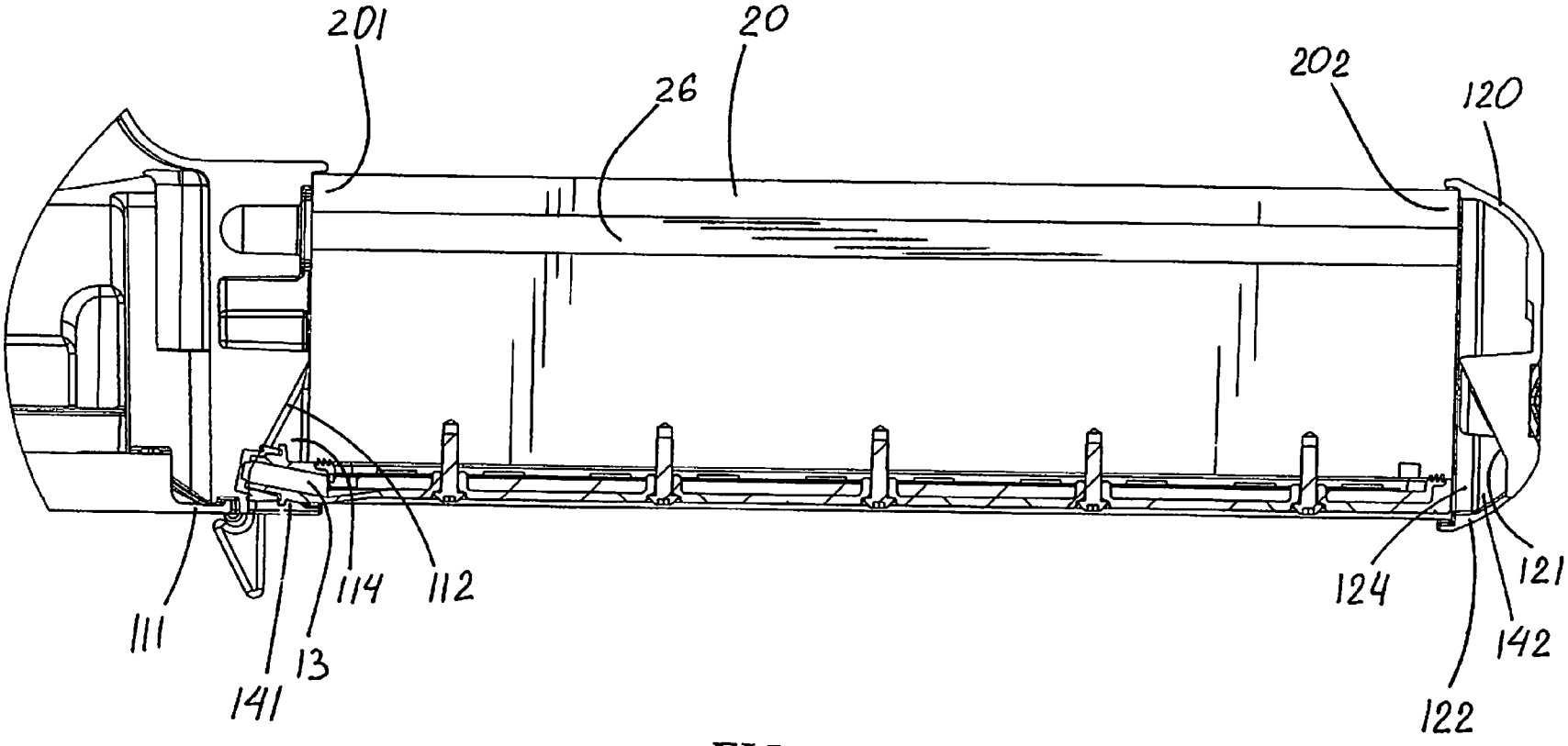
FIG. 7 is a fragmentary lengthwise cross-sectional view of the LED light fixture of FIG. 1 taken along lines 7-7.
Figure 8:
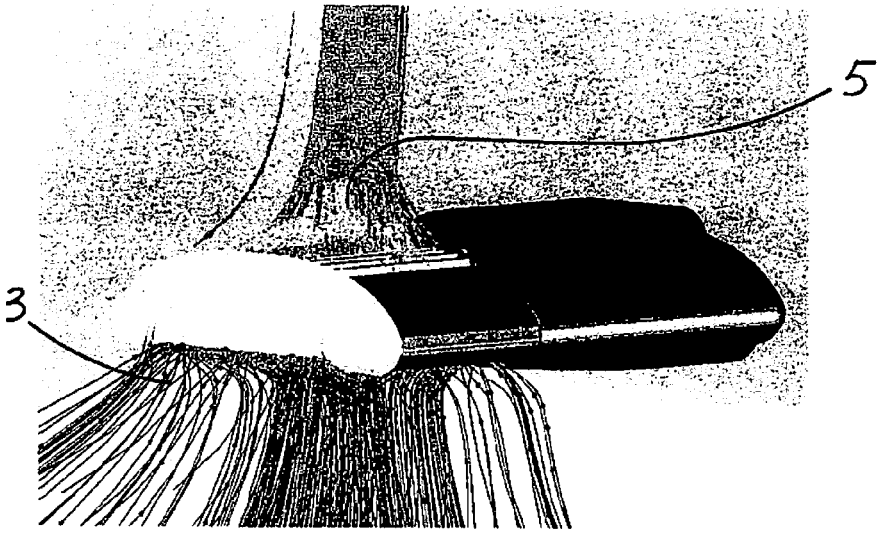
FIGS. 8-10 are heat-dissipation diagrams showing air-flow through the LED light fixture.
Figure 9:
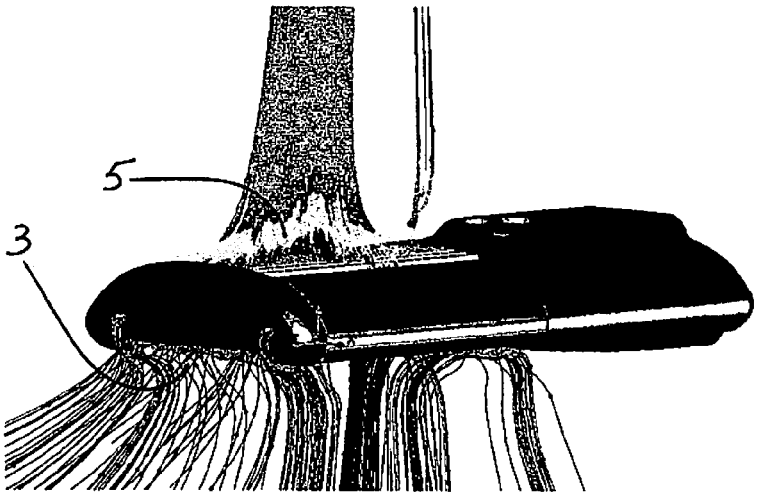
Figure 10:
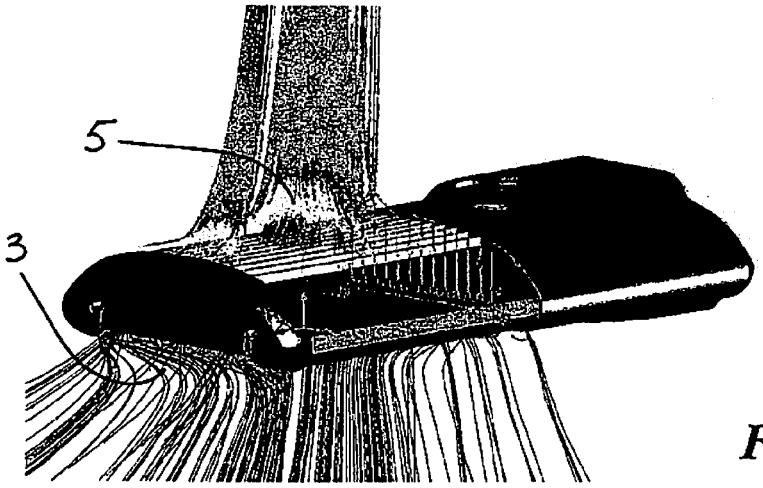

As best seen at least in FIGS. 7, 12 ,14, 27 and 30, housing 10 forms a venting gap 14 between each end-portion 11 and 12 and single-piece extrusion 20 to provide ingress of cool air 3 to and along the heat-dissipating surfaces 241 by upward flow of heated air 5 therefrom. FIGS. 8-10 illustrate the flow of air through heat-dissipating section 24 of extrusion 20. The upward flow of heated air 5 draws cool air 3 into heat-dissipating section 24 and along heat-dissipating surfaces 241 without any aid from mechanical devices such as fans or the like.

Figure 11:
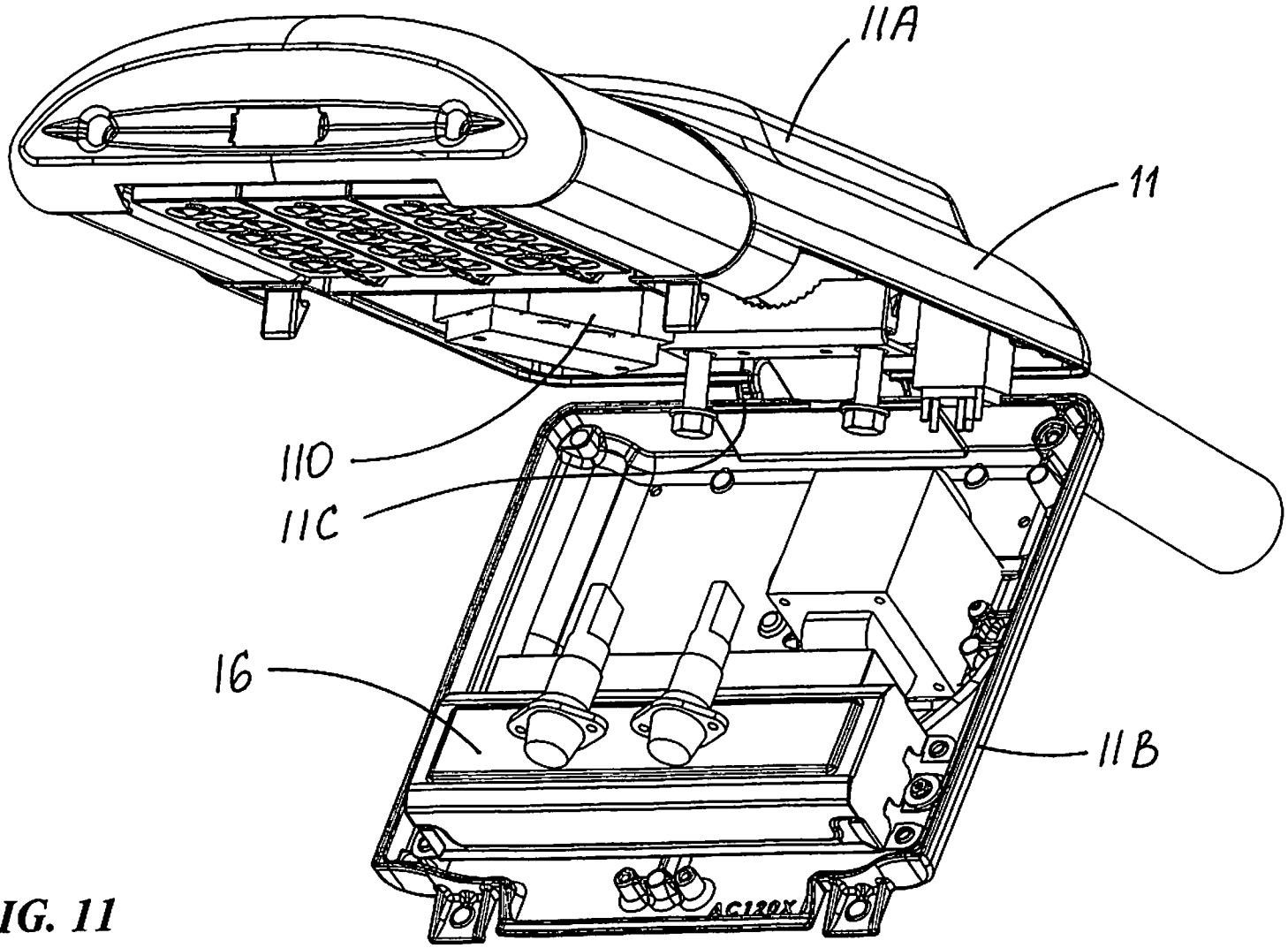
FIG. 11 is a perspective view from below of the LED light fixture of FIG. 1 shown with a lower portion in open position.

As seen in FIG. 11, first end-portion 11 forms a water/air-tight chamber 110 enclosing an electronic LED driver 16 and/or other electronic and electrical components needed for LED light fixtures. First end-portion 11 has upper and lower portions 11A and 11B which are hinged together by a hinge 11C. This hinging arrangement facilitates easy opening of first end-portion 11 by the downward swinging of lower portion 11B. LED driver 16 is mounted on lower portion 11B for easy maintenance.

Figure 27:
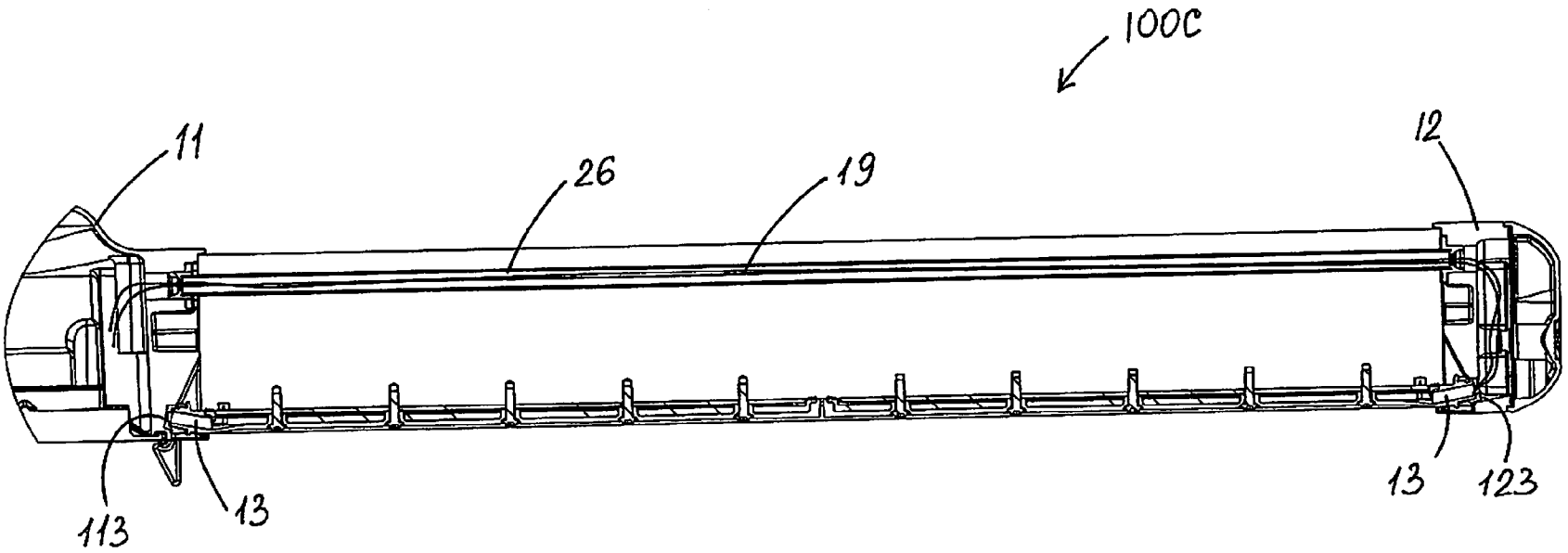
FIG. 27 is fragmentary lengthwise cross-sectional view of the LED light fixture of FIG. 17 taken along lines 27-27 to show a closed wireway formed of and along the extrusion.
Figure 30:
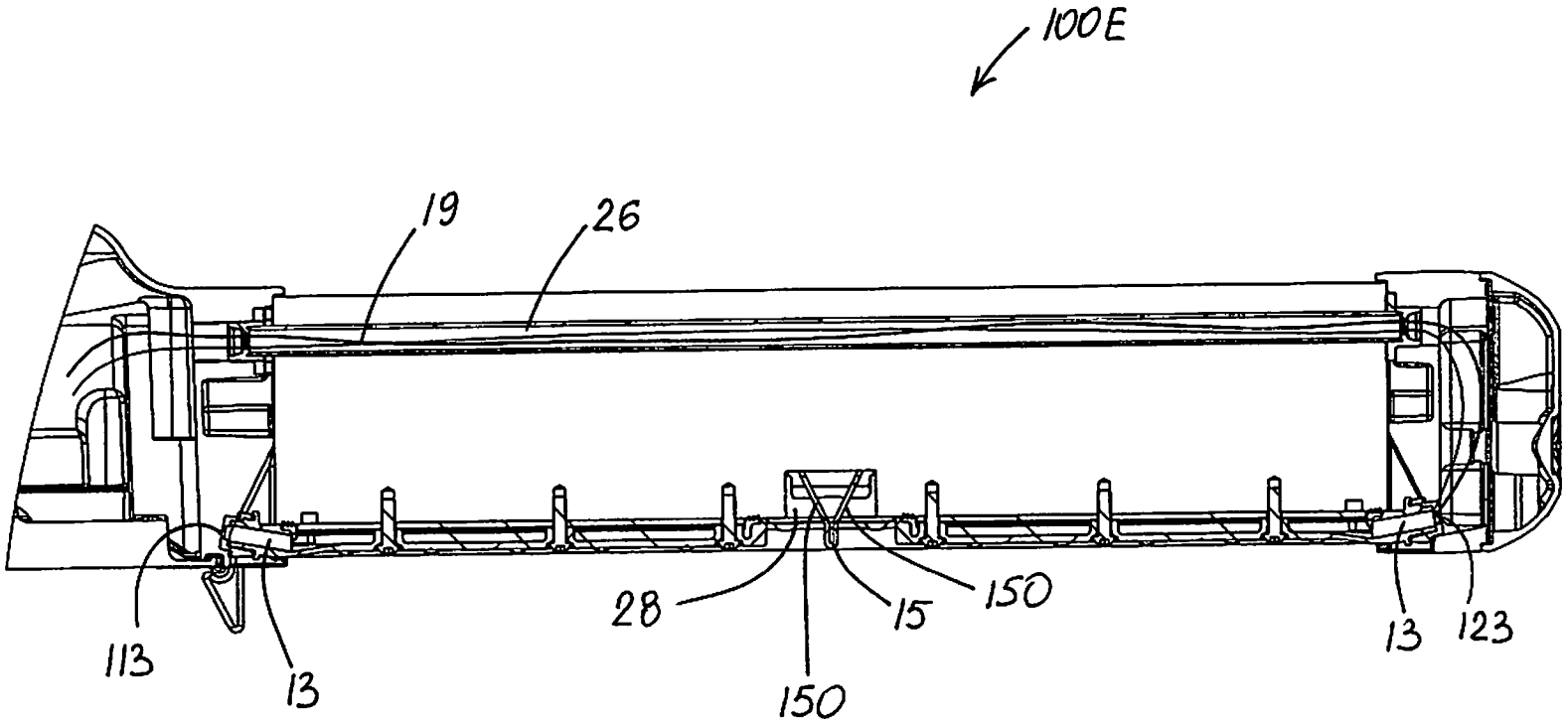
FIG. 30 is a fragmentary lengthwise cross-sectional view of the LED light fixture of FIG. 28 taken along lines 30-30.
Figure 31:
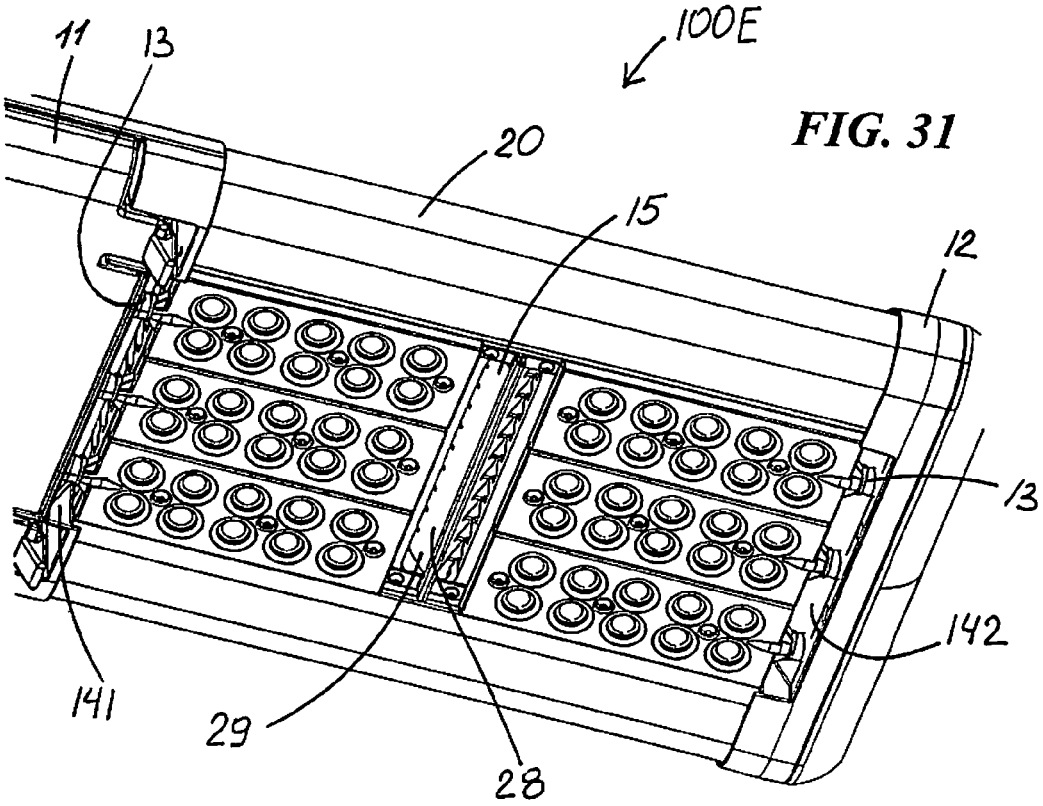
FIG. 31 is a fragmentary perspective view from below of the LED light fixture of FIG. 28 showing a deflector member within the venting aperture.
Figure 32:
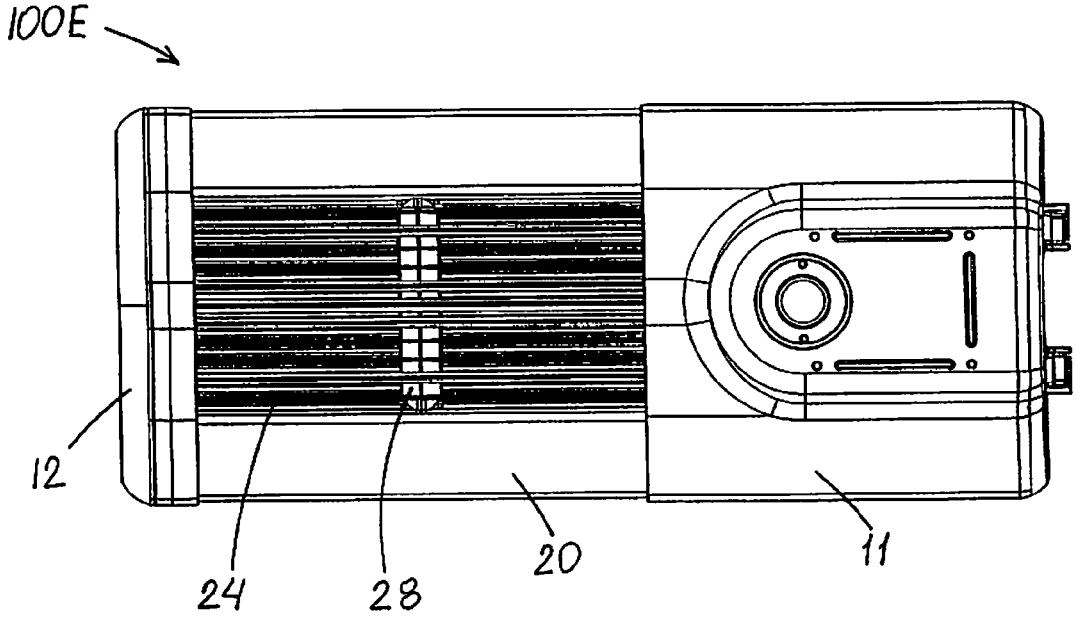
FIG. 32 is a top plan view of the embodiment of the LED light fixture of FIG. 28.

First end-portion 11 at first end 201 of extrusion 20 has a lower surface 111 and an extrusion-adjacent end surface 112. As best seen in FIGS. 7, 27 and 30, extrusion-adjacent end surface 112 and lower surface 111 form a first recess 114 which extends away from first end 201 of extrusion 20 and defines a first venting gap 141. End surface 112 along first recess 114 is tapered such that first venting gap 141 is upwardly narrowed, thereby to direct and accelerate the air flow along heat-dissipating surfaces 241.

Endcap 120 at second end 202 of extrusion 20 has an inner surface 121 and a lower edge-portion 122 Inner surface 121 and lower edge-portion 122 of endcap 120 form a second recess 124 which extends away from second end 202 of extrusion 20 and defines a second venting gap 142 Inner surface 121 along second recess 142 is tapered such that second venting gap 142 is upwardly narrowed, thereby to direct and accelerate the air flow along heat-dissipating surfaces 241.

As best seen in FIGS. 1, 3, 7 and 11-31, LED arrangement 30 is secured outside water/air-tight chamber 110 and is free from fixture enclosures. LED arrangement 30 includes a plurality of LED-array modules 31 or 32. As further seen in these FIGURES, LED-array modules 31 and 32 are substantially rectangular elongate modules.

Figure 15:
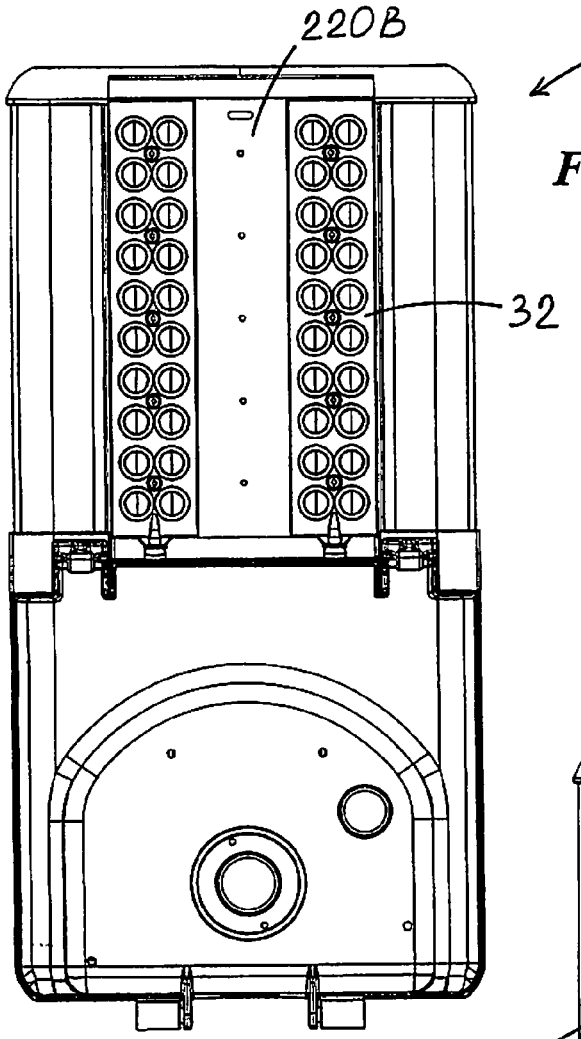
FIG. 15 is a bottom plan view of the LED light fixture of FIG. 14 with an LED arrangement including two side-by-side LED-array modules.
Figure 16:
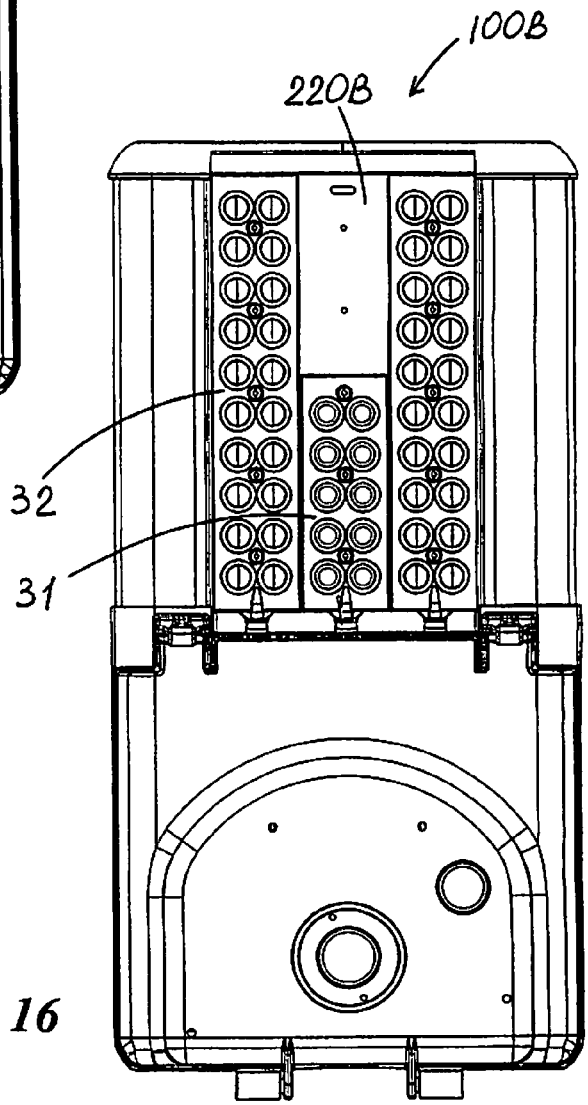
FIG. 16 is a bottom plan view of the LED light fixture of FIG. 14 with an LED arrangement including side-by-side LED-array modules having different lengths.
Figure 17:
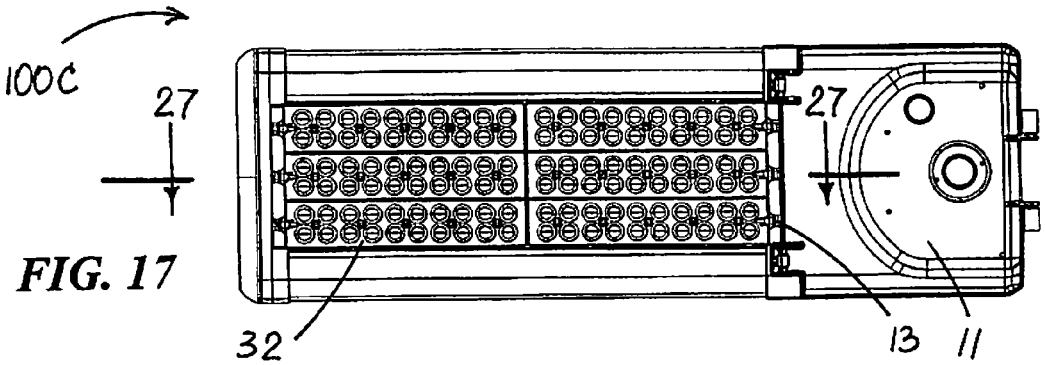
FIG. 17 is a bottom plan view of an embodiment of the LED light fixture with LED-array modules mounted in end-to-end relationship to one another.
Figure 18:
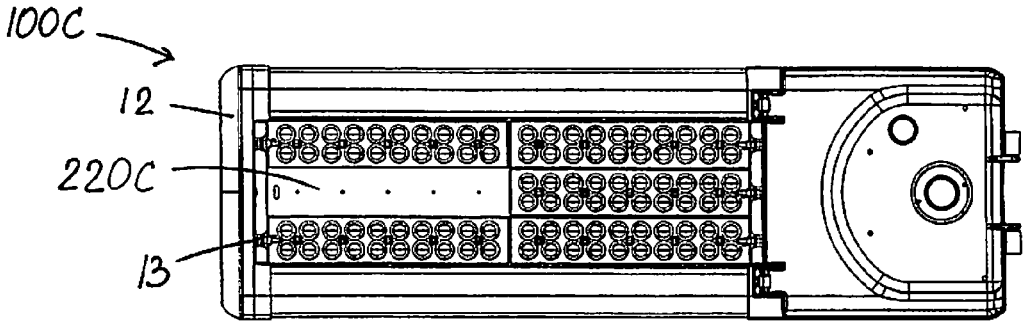
FIGS. 18-20 are bottom plan views of embodiment of the LED light fixture of FIG. 17 with same-length LED-array modules mounted in end-to-end relationship to one another showing alternative arrangements of the LED-array modules.
Figure 19:
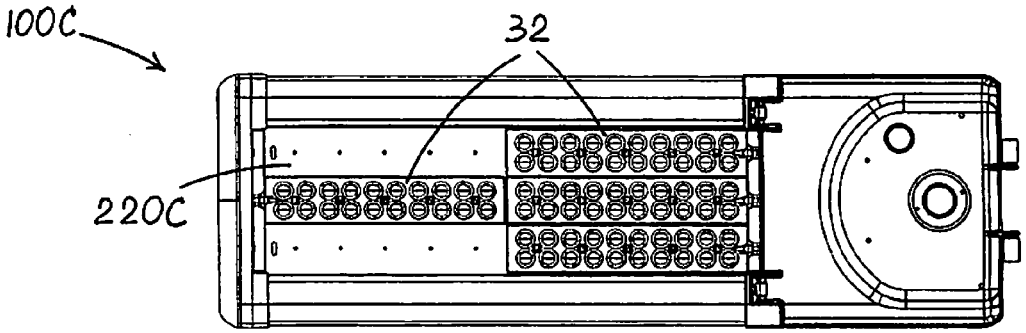
Figure 20:
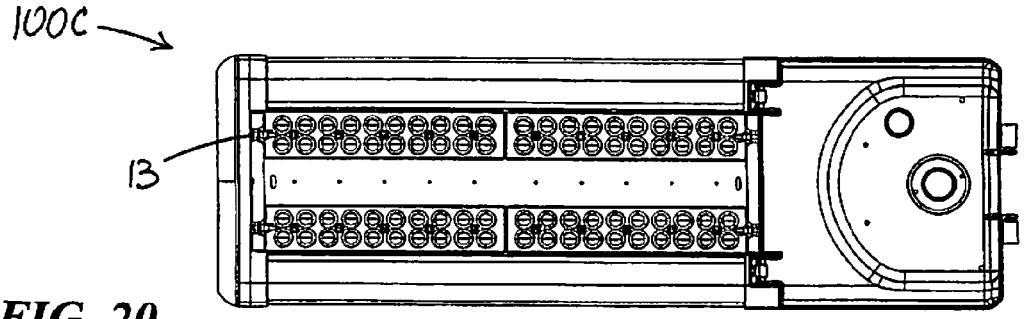

LED-array modules 31 and 32 each have a common module-width 310 (see FIGS. 12-31). LED-adjacent surface 220A has a width 222 which is approximately the multiple of the maximum number of LED-array modules mountable in side-by-side relationship thereon by common module-width 310. FIGS. 13, 15 and 16 show alternative arrangements of LED-array modules 31 on LED-adjacent surface 220 of same width 222 as shown in FIGS. 12 and 14.

LED-array modules further have predetermined module-lengths associated with the numbers of LEDs 18 on modules 31 or 32.

Figure 12:
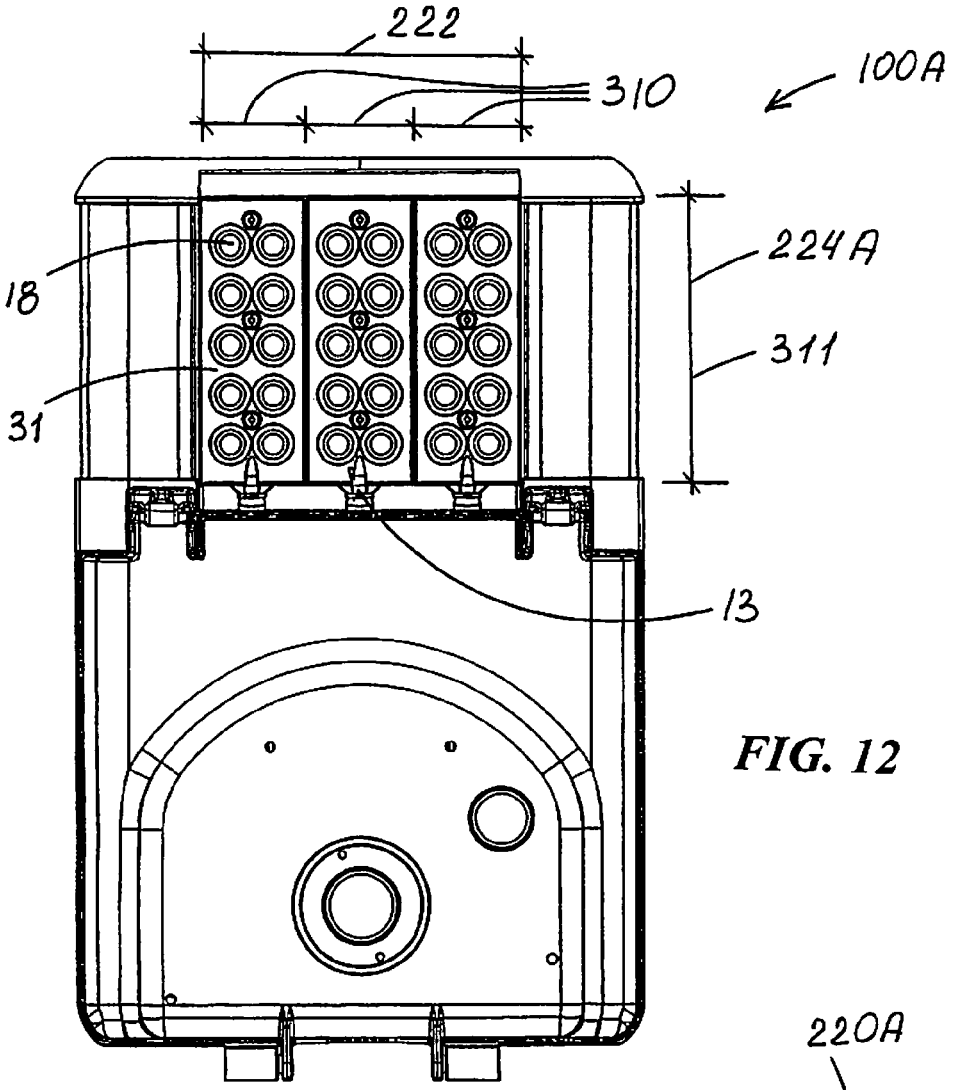
FIG. 12 is a bottom plan view of the LED light fixture of FIG. 1.
Figure 13:
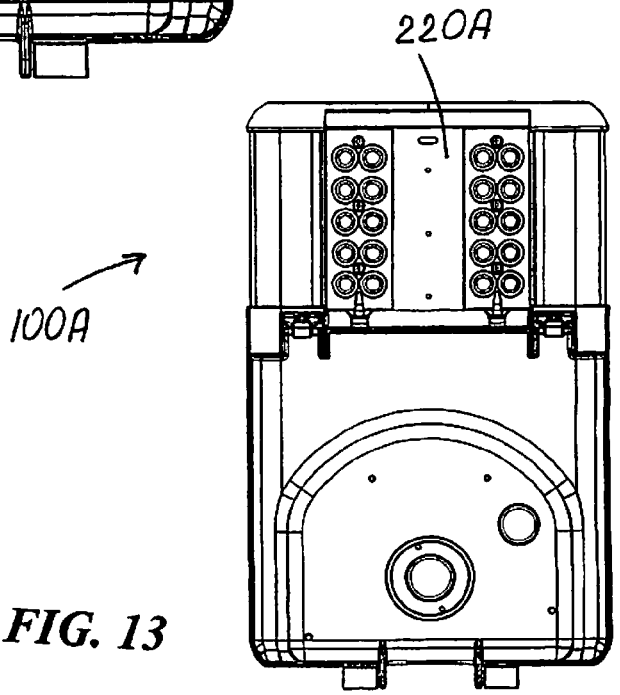
FIG. 13 is a bottom plan view of the LED light fixture of FIG. 12 with an LED arrangement including two side-by-side LED-array modules.

FIGS. 1 and 12 best show LED light fixture 100A with modules 31 each having ten LEDs 18 thereon determining a module-length 311. Fixture 100A has LED-adjacent surface 220A with a length 224A which is approximately a dimension of predetermined module-lengths 311.

Figure 3:
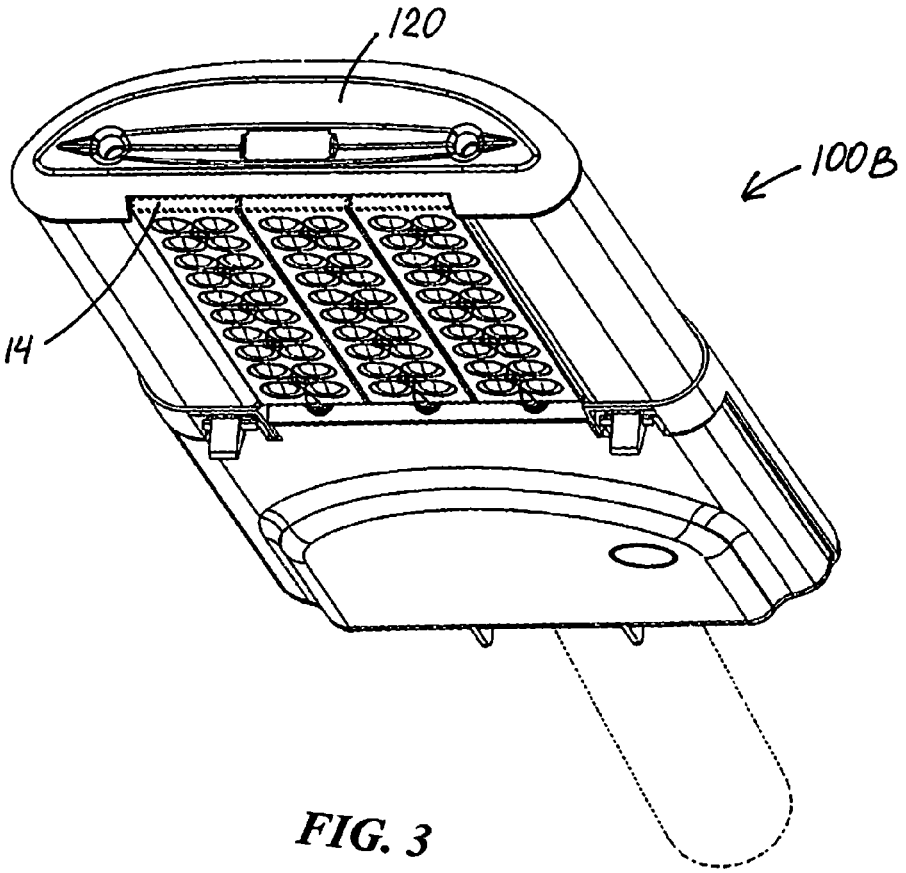
FIG. 3 is a perspective view from below of another embodiment of an LED light fixture including LED-array modules with twenty LEDs thereon.
Figure 4:
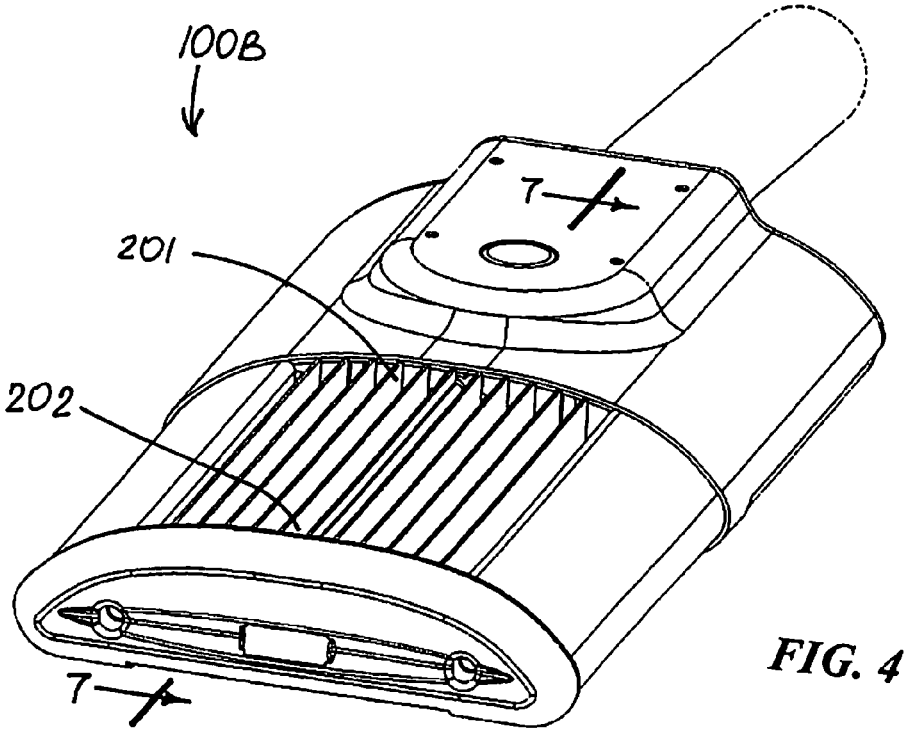
FIG. 4 is a perspective view from above of the LED light fixture of FIG. 3.
Figure 14:
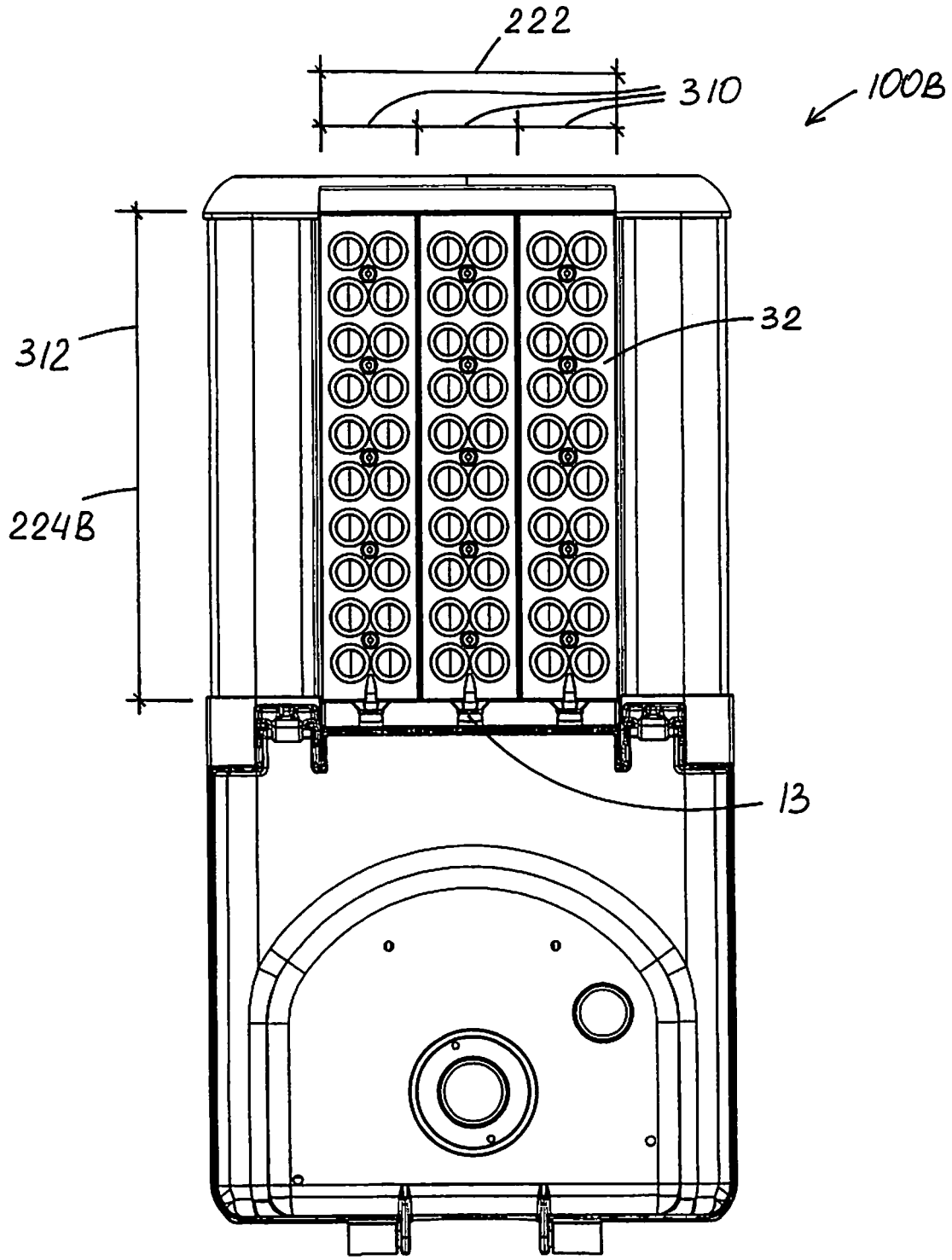
FIG. 14 is a bottom plan view of the LED light fixture of FIG. 3.

FIGS. 3 and 14 best show LED light fixture 100B with modules 32 each having twenty LEDs 18 thereon determining a module-length 312. Fixture 100B has LED-adjacent surface 220B with a length 224B which is approximately a dimension of predetermined module-lengths 312.

FIGS. 13 and 15 illustrate how, based on illumination requirements, LED lighting fixture 100 allows for a variation in a number of modules 31 or 32 mounted on LED-adjacent surface 220. FIG. 16 illustrates a combination of different-length modules 31 and 32 on LED-adjacent surface 220B.

Figure 21:
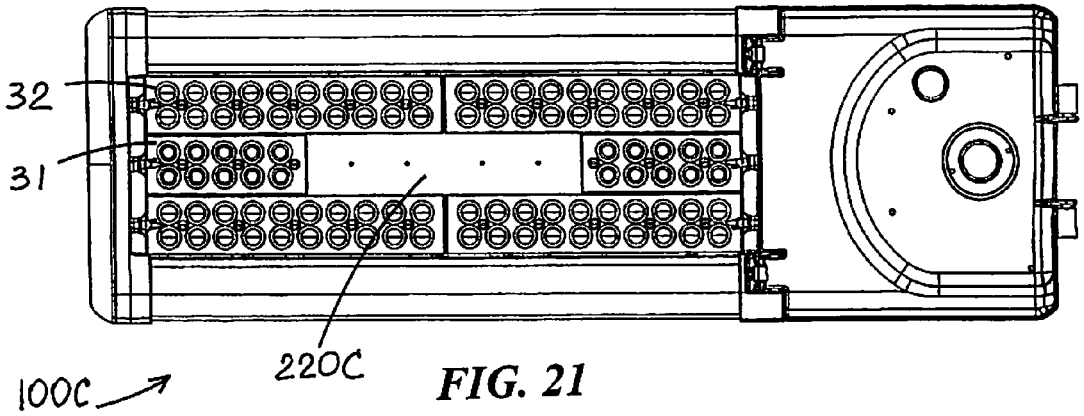
FIGS. 21, 22 and 22A are bottom plan views of yet more embodiments of the LED light fixture of FIG. 17 showing an LED arrangement with a combination of same-length and different-length LED-array modules in end-to-end relationship to one another.
Figure 22:
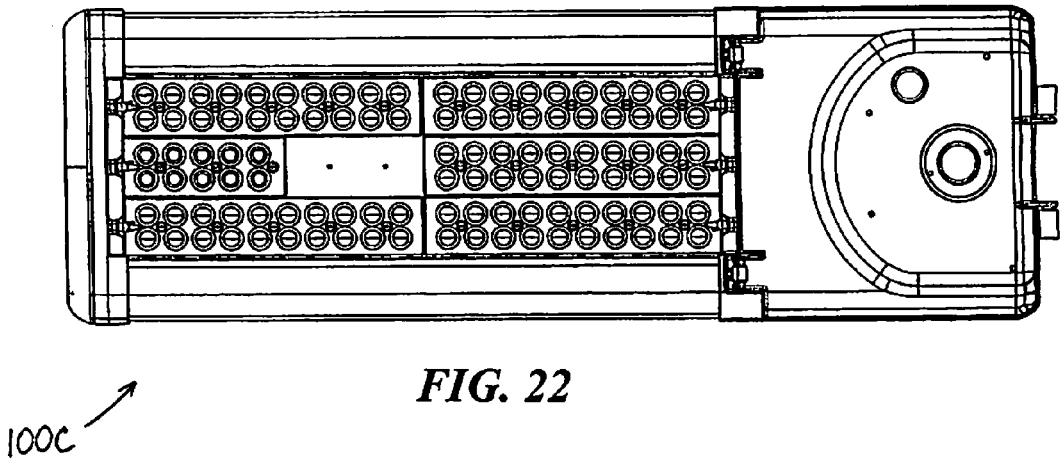
Figure 22A:
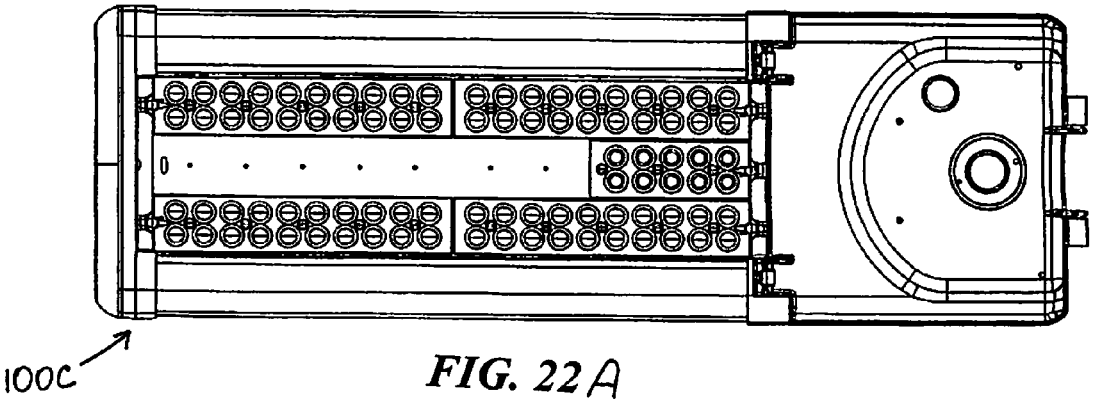
Figure 23:
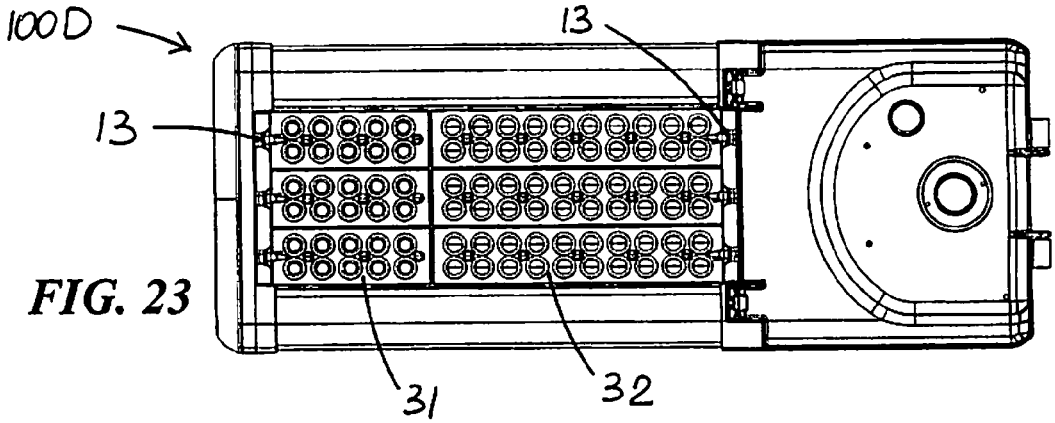
FIG. 23 is a bottom plan view of still another embodiment of the LED light fixture with different-length LED-array modules mounted in end-to-end relationship to one another.
Figure 24:
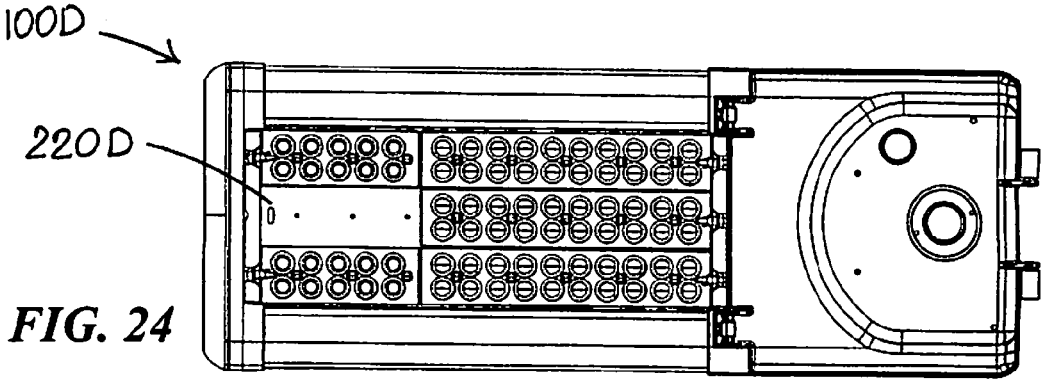
FIGS. 24-26 are bottom plan views of alternative embodiments of the LED light fixture of FIG. 23 showing alternative arrangements of such LED-array modules.
Figure 25:
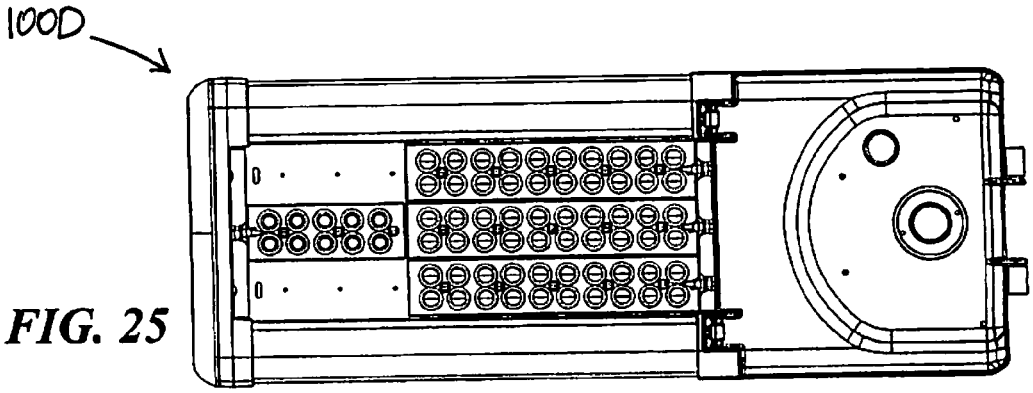
Figure 26:
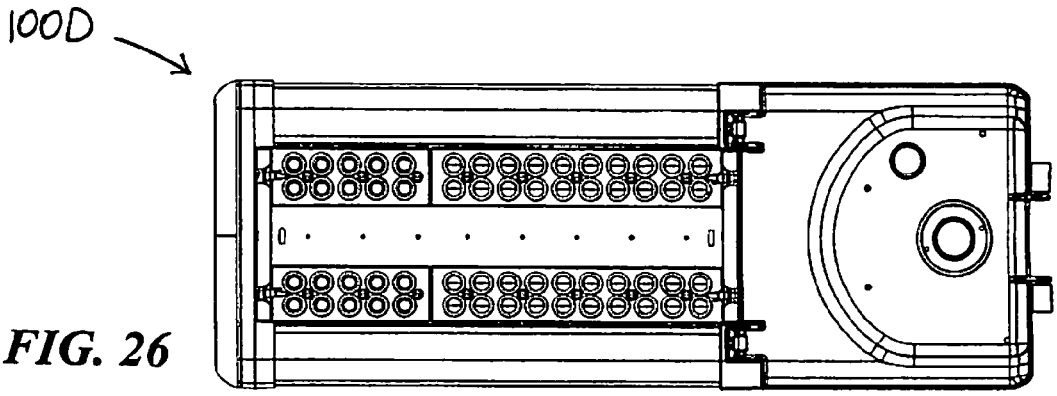

FIGS. 17-20 show an LED light fixture 100C with modules 32 each having twenty LEDs 18 thereon determining a module-length 312. Fixture 100C has LED-adjacent surface 220C with a length 224C which is approximately a double of module-length 312 of each of LED-array modules 32. FIGS. 17-20 show alternative arrangements of LED-array modules 32 on LED-adjacent surface 220C of same width 222. FIGS. 21, 22 and 22A show a combination of different-length modules 31 and 32 on LED-adjacent surface 220C. Such arrangement allows for providing a reduced illumination intensity by reducing a number of LED modules 32 or using modules 31 with less LEDs FIGS. 23-26 show an LED light fixture 100D with LED-adjacent surface 220D supporting a plurality of modules of different module-lengths—both modules 31 (ten LEDs 18) with module-length 311 and modules 32 (twenty LEDs 18) with module-length 312. Fixture 100D has LED-adjacent surface 220D with a length 224D which is approximately a sum of module-lengths 311 and 312 of pairs of LED-array modules 31 and 32 in end-to-end relationship to one another. FIGS. 23-26 show alternative arrangements of LED-array modules 31 and 32 on LED-adjacent surface 220D.

FIGS. 17-26 illustrate fixtures 100C and 100D with the plurality of LED-array modules 31 and 32 in end-to-end relationship to one another. In such arrangement, the modules are positioned as modules 33 which are proximal to first end-portion 11, and modules 34 which are distal from first end-portion 11. It can be seen in FIGS. 7, 27 and 30, modules 31 and 32 include wireways 13 that connect to water/air-tight wire-accesses 113 and 123 of first and second end-portions 11 and 12, respectively.

Figure 5:
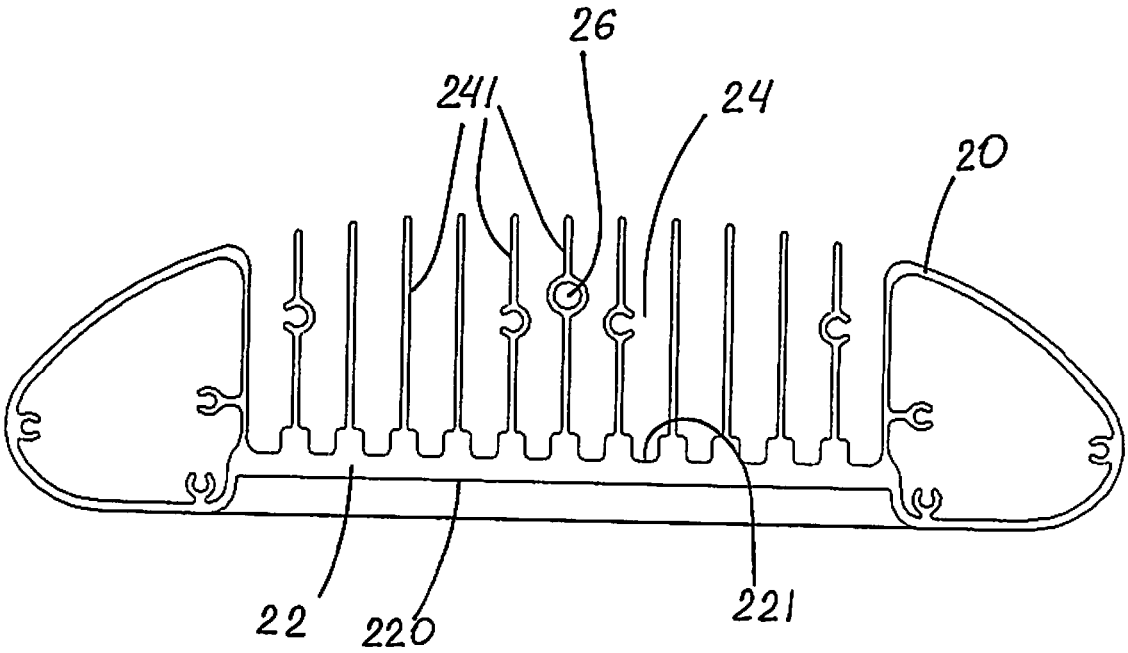
FIG. 5 is a widthwise cross-sectional view of the LED light fixture across the single-piece extrusion showing one configuration of the extrusion.
Figure 6:
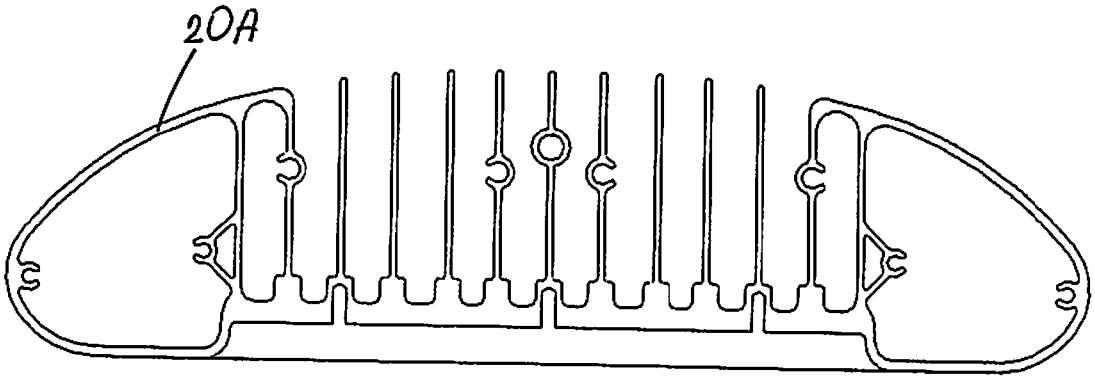
FIG. 6 is a widthwise cross-sectional view of the LED light fixture across the single-piece extrusion showing another configuration of the extrusion.
Figure 37:
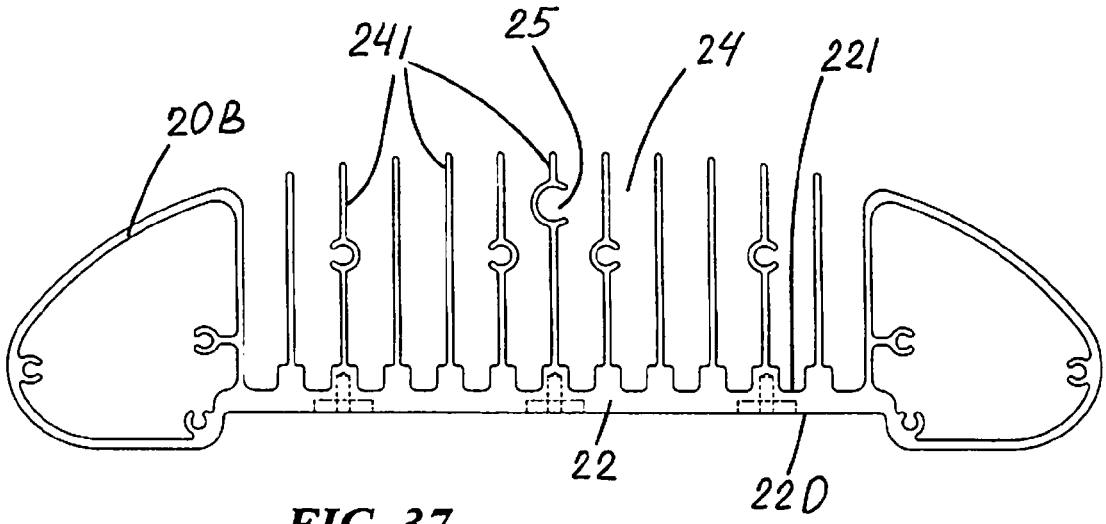
FIG. 37 is a widthwise cross-sectional view of the LED light fixture across the single-piece extrusion showing an example of a wireway retention channel
Figure 38:
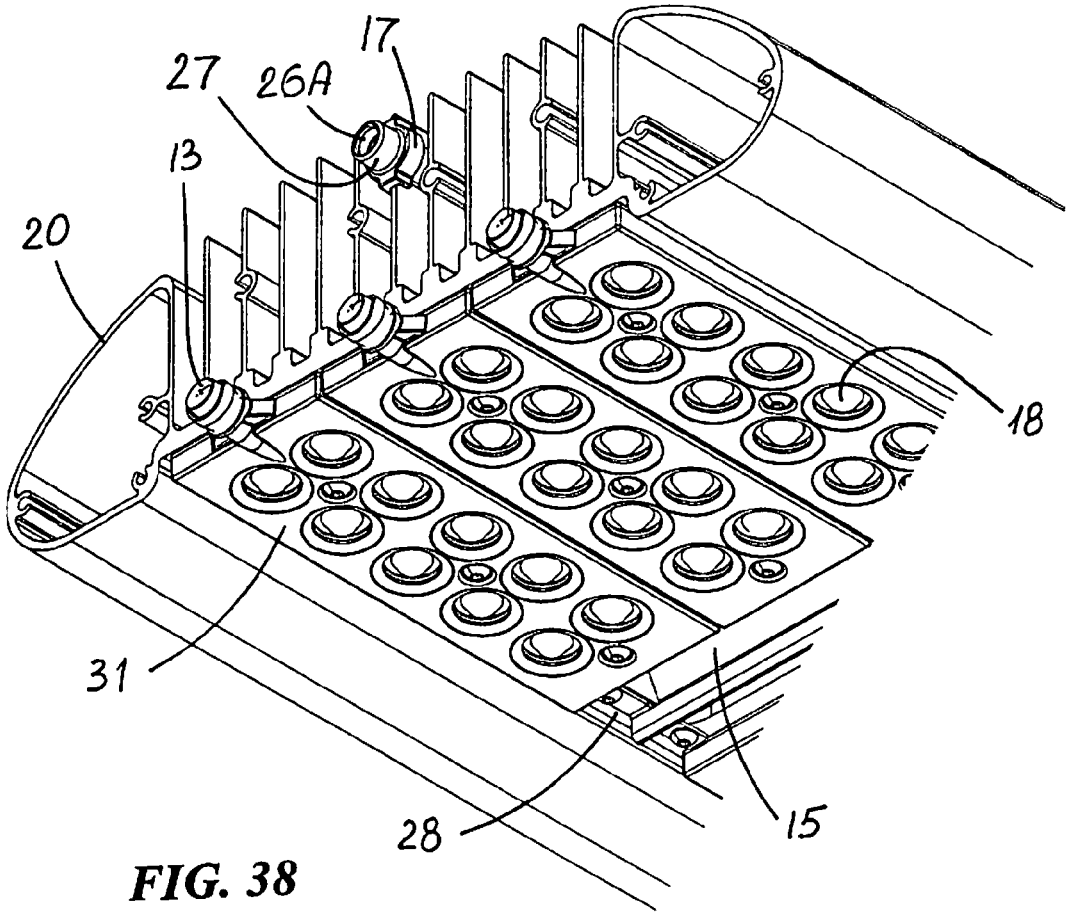
FIG. 38 is a fragmentary perspective view from below of the single-piece extrusion of the LED light fixture of FIG. 22.
Figure 39:
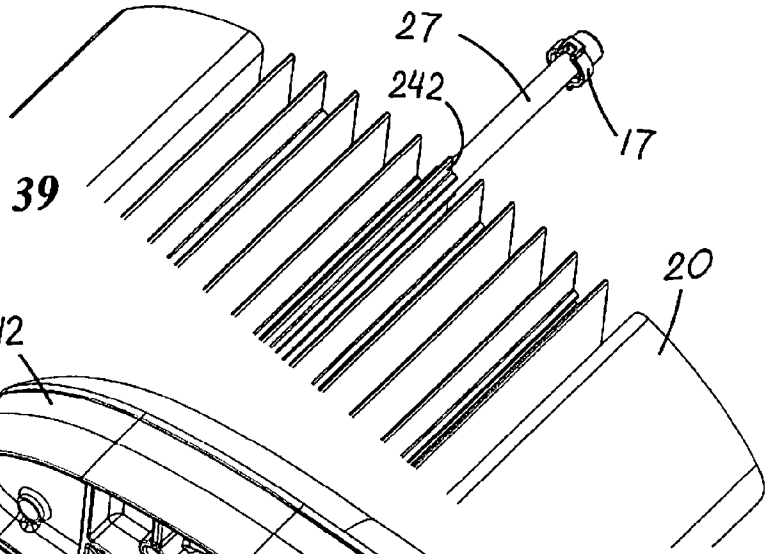
FIG. 39 is a fragmentary perspective view from above of the single-piece extrusion of FIG. 37 showing a wireway tube extending from the retention channel.
Figure 40:
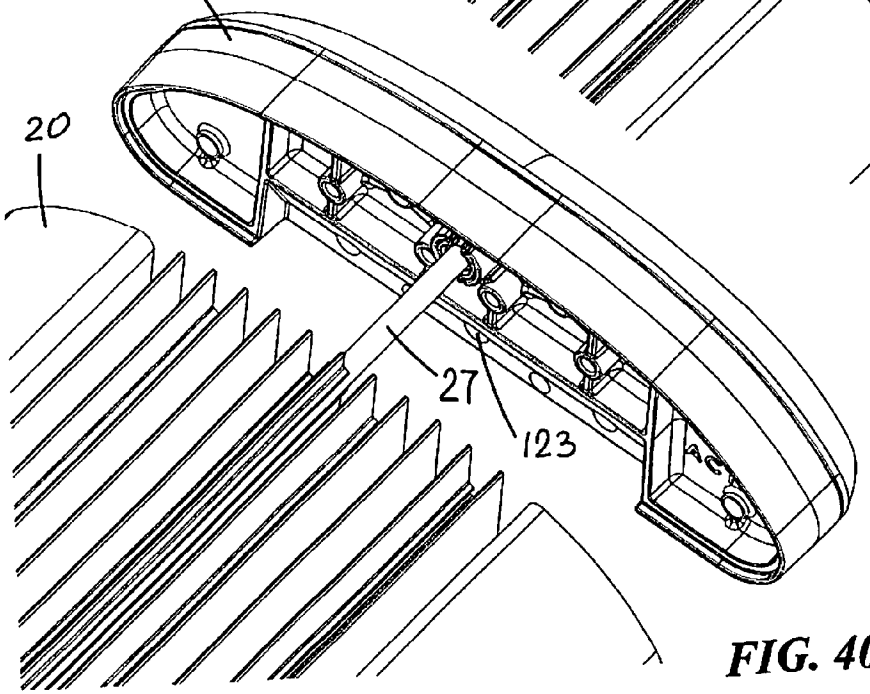
FIG. 40 is a fragmentary perspective view from above of the single-piece extrusion of FIG. 37 showing a wireway tube extending from the retention channel and received by the second end-portion.
Figure 41:
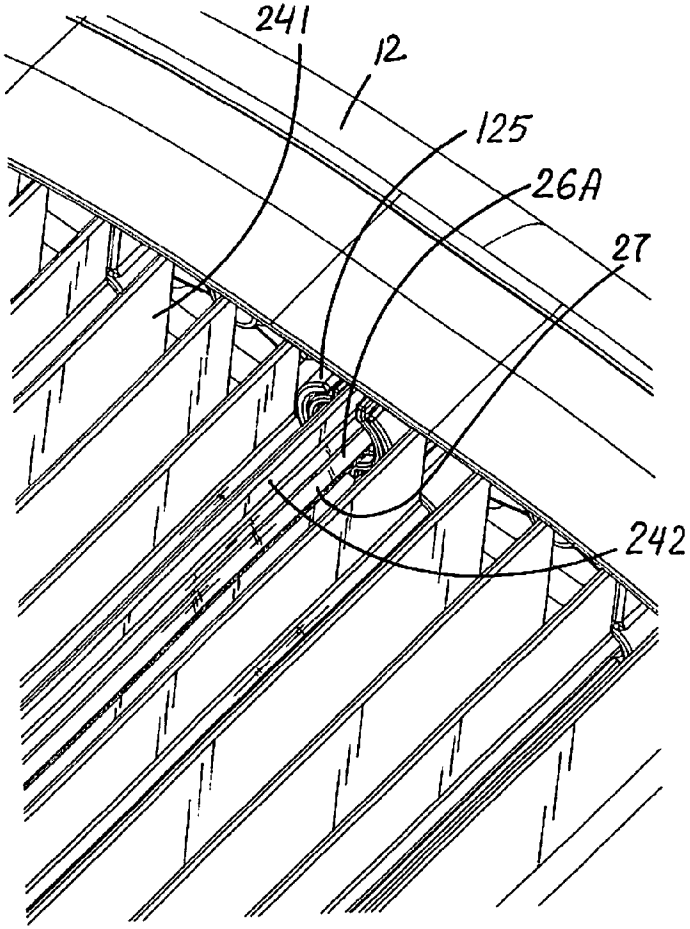
FIG. 41 is a fragmentary perspective view from above of the single-piece extrusion of FIG. 37 with the wireway tube secured with respect to the second end-portion.

Extrusion 20 includes a water/air-tight wireway 26 for receiving wires 19 from distal LED-array modules 34. Wireway 26 is connected to housing 10 through wire-accesses 115 and 125 of first and second end-portions 11 and 12, respectively. Wires 19 from distal modules 34 reach water/air-tight chamber 110 of first end-portion 11 through wireway 26 connected to water/air-tight wire-access 115. Wireway 26 extends along and through heat-dissipating section 24 and is spaced from base 22. Heat-dissipating section 24 includes parallel fins 242 along the lengths of single-piece extrusion 20. FIGS. 5 and 6 illustrate wireway 26 as formed of and along fin 242. Fin 242 is a middle fin positioned at longitudinal axis of extrusion 20. However, wireway 26 may be formed along any other fin. Such choice depends on the fixture configuration and is in no way limited to the shown embodiments. Wireway 26 may be positioned along fin 242 at any distance from base 22 that provides safe temperatures for wires 19. It should, therefore, be appreciated that wireway 26 may be positioned at a tip of fin 242 with the farthest distance from base 22. Alternatively, if temperature characteristics allow, wireway 26 may be positioned near the middle of fin 242 and closer to base 22. FIG. 38 shows wireway 26A as an enclosed tube 27 secured with respect to fin 242. As can be seen in FIGS. 37 and 39-41, fin 242 forms an extruded retention channel 25 securely retaining wireway tube 27 therein. Wireway 26A may have a jacketed cord or rigid tube which is made of aluminum or other suitable material. As best seen in FIG. 37, extruded retention channel 25 has an open "C" shape with an opening being smaller than the largest inner diameter. When the jacketed cord is secured with respect to fin 242 by snap fitting or the rigid tube is slid inside retention channel 25, retention channel 25 securely holds wireway tube 27.

Wire-accesses 115, 125 and wireway 26 provide small surfaces between water/air-tight chamber and non-water/air-tight environment. Such small surfaces are insulated with sealing gaskets 17 thereabout. In inventive LED light fixture 100, the mounting of single-piece extrusion 20 with respect to end-portions 11 and 12 provides sufficient pressure on sealing gaskets 17 such that no additional seal, silicon or the like, is necessary.

FIGS. 28-32 show LED light fixture 100E in which single-piece extrusion 20E has a venting aperture 28 therethrough to provide ingress of cool-air 3 to and along heat-dissipating surfaces 241 by upward flow of heated air 5 from surfaces 241. Venting aperture 28, as shown in FIGS. 28, 29, 31 and 32, is elongate aperture across a majority of the width of base 22. FIGS. 28-31 further show a deflector member 15 secured to base 22 along elongate aperture 28. Deflector member 15 has a pair of oppositely-facing beveled deflector surfaces 150 oriented to direct and accelerate air flow in opposite directions along heat-dissipating surfaces 241.

In LED light fixture 100E, as shown in FIGS. 28-32, the plurality of LED-array modules 31 are in lengthwise relationship to one another. Venting aperture 28 is distal from first and second ends 201 and 202 of extrusion 20.

In LED light fixture 100E distal LED-array modules 34 are spaced from proximal LED-array modules 33. Venting aperture 28 is distal from first and second ends 201 and 202 of extrusion 20 and is at the space 29 between proximal and distal LED-array modules 33 and 34.

Figure 28:
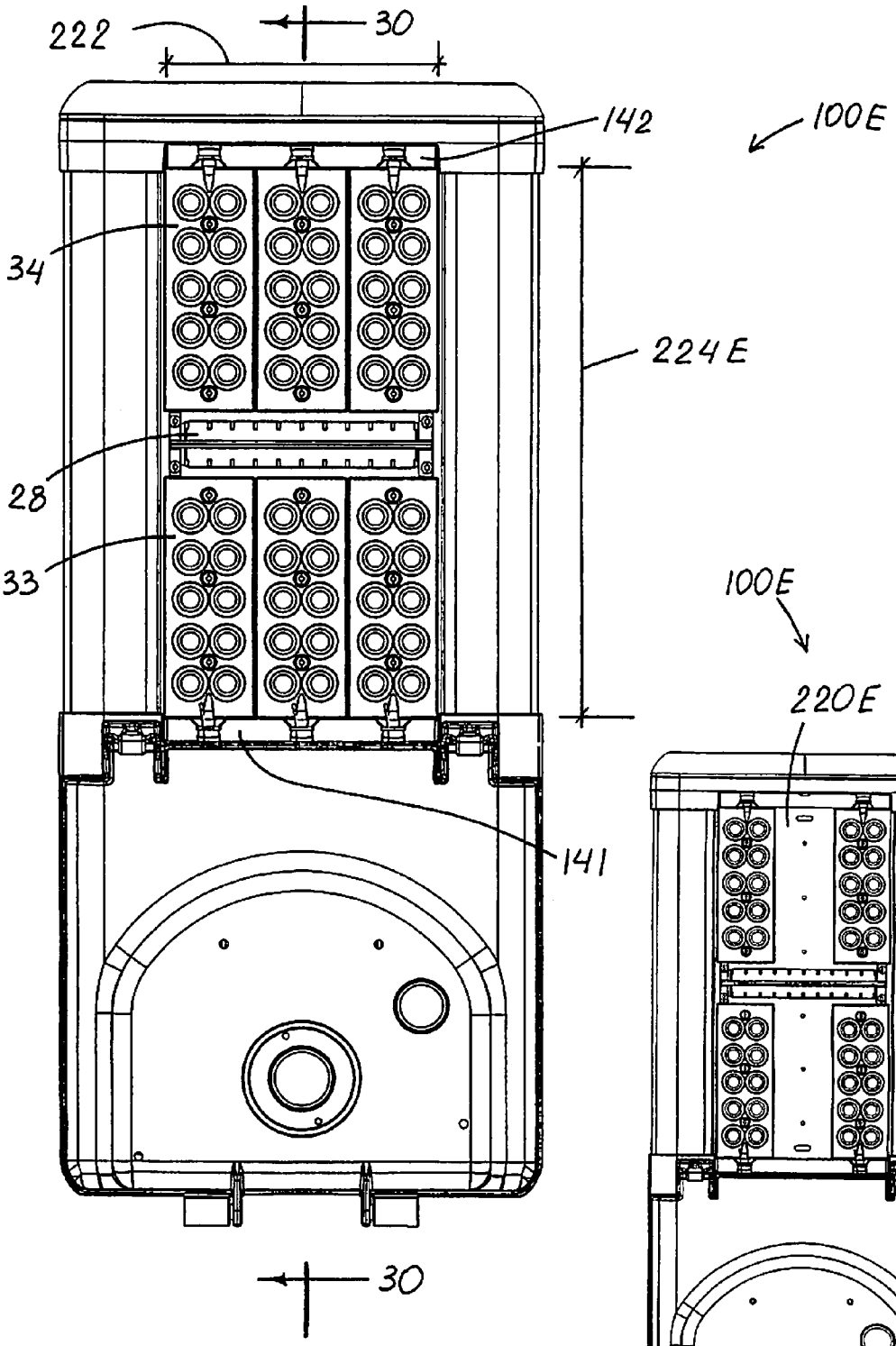
FIG. 28 is a bottom plan view of an embodiment of the LED light fixture which has a venting aperture through a base of the extrusion.
Figure 29:
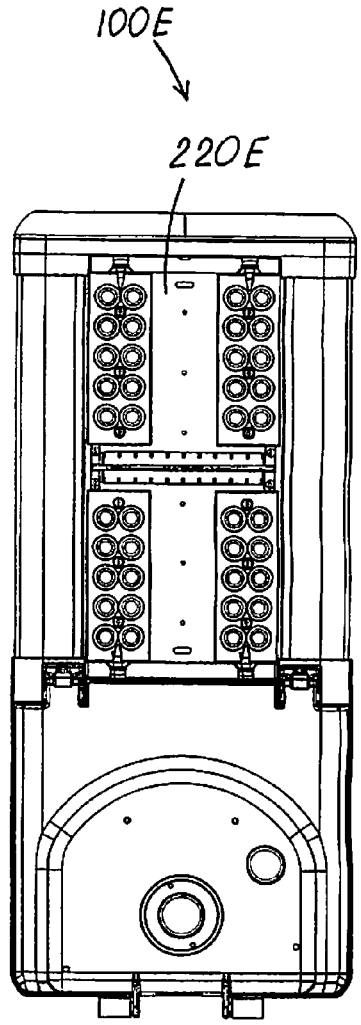
FIG. 29 is a bottom plan view of another embodiment of the LED light fixture as in FIG. 28 but for alternative arrangement of LED modules.

LED-adjacent surface 220E of fixture 100E has a length 224E. As best shown in FIG. 28, length 224E is approximately a dimension which is (a) the sum of module-length 311 of pairs of end-to-end LED-array modules 31 plus (b) the length of space 29 between proximal and distal LED-array modules 33 and 34. LED-adjacent surface 220E, as further shown in FIG. 28, has width 222 which is approximately the multiple of the three LED-array modules 31 mounted in side-by-side relationship thereon by module-width 310.

Figure 33:
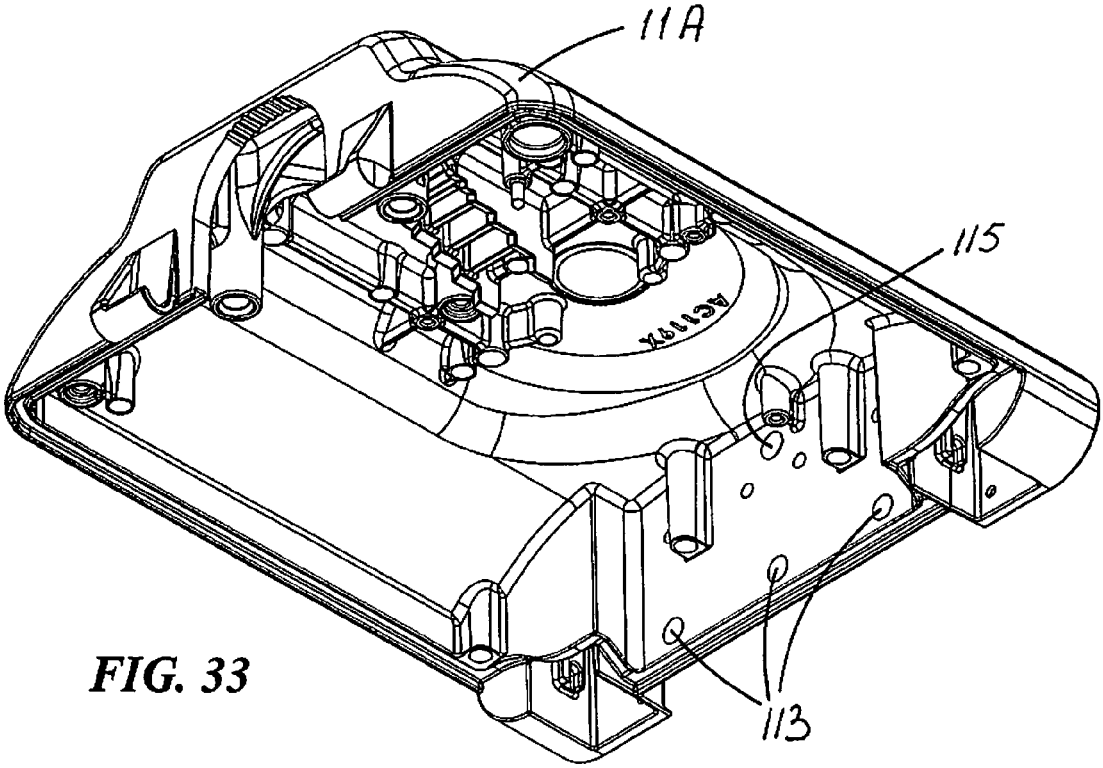
FIG. 33 is a perspective view from below of an upper portion of a first-end portion of a housing of the inventive LED light fixture.
Figure 34:
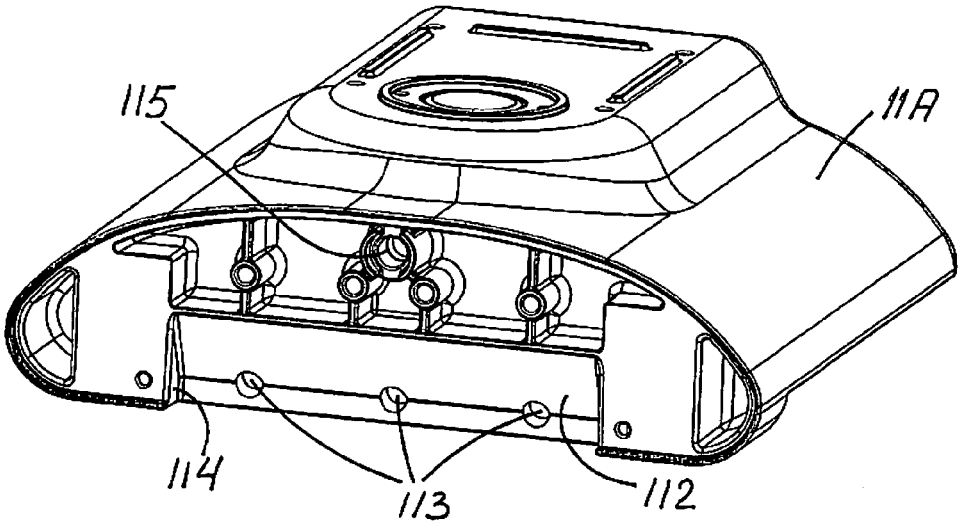
FIG. 34 is front perspective view of the upper portion of FIG. 33.

FIGS. 33 and 34 best illustrate first end-portion 11 which is configured for mating arrangement of with single-piece extrusion 20 and its wireway 26.

Figure 35:
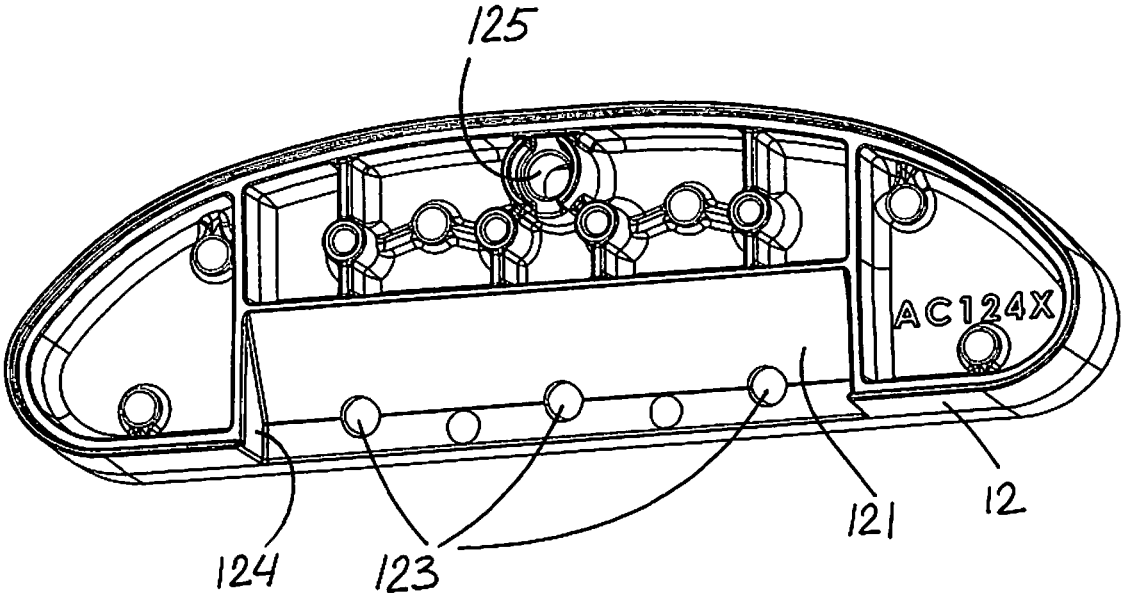
FIG. 35 is a rear perspective view of an end-casting of a second-end portion of the housing of the inventive LED light fixture.
Figure 36:
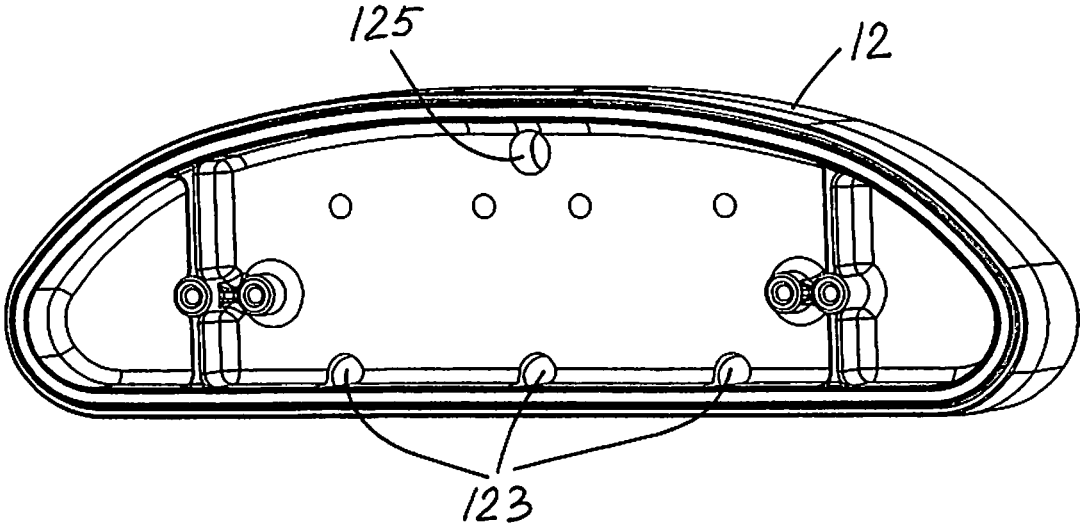
FIG. 36 is a front perspective view of the end-casting of FIG. 34.

FIGS. 35 and 36 illustrate second end-portion 12 which is configured for mating arrangement with single-piece extrusion 20 and its wireway 26 and shows wire-accesses 123 and 125 through which wires 19 are received into second end-portion 12 and channeled to wireway 26.

While the principles of the invention have been shown and described in connection with specific embodiments, it is to be understood that such embodiments are by way of example and are not limiting.

The invention claimed is:

1. An LED light fixture comprising:

a housing;

a heat sink secured with respect to the housing and having a base with front and back surfaces, the back surface being open to water/air flow thereover;

an LED arrangement at the front surface of the heat sink; and at least one closed channel extending along the base and spaced therefrom for receiving wire connections for the LED arrangement.

2. The LED light fixture of claim 1 wherein:

the LED arrangement comprises at least first and second LED modules, the first LED module being proximal to the housing; and the at least one closed channel receives wiring extending to/from the second LED module.

3. The LED light fixture of claim 2 wherein the first and second LED modules are in end-to-end relationship to one another such that the second LED module is distal from the housing.

4. The LED light fixture of claim 3 wherein the housing comprises a wire-access(es) receiving wires to/from the first LED module proximal to the housing.

5. The LED light fixture of claim 4 wherein the housing and the heat sink define at least one venting gap therebetween.

6. The LED light fixture of claim 2 wherein the at least one closed channel extends along the back surface of the base.

7. The LED light fixture of claim 6 wherein the least one closed channel is at least partially formed by the heat sink.

8. The LED light fixture of claim 7 wherein the heat sink includes parallel fins extending from the back surface, the least one elongate channel being formed along the fin(s).

9. The LED light fixture of claim 7 wherein the heat sink is an extrusion forming the at least one elongate closed wiring channel therealong.

10. The LED light fixture of claim 2 further comprising at least one venting gap therebetween the housing and the heat sink.

11. The LED light fixture of claim 10 wherein the housing comprises a wire-access(es) receiving wires from the first LED module proximal to the housing.

12. The LED light fixture of claim 10 further comprising at least one venting aperture through the base.

13. The LED light fixture of claim 12 wherein the at least one closed channel extends along the back surface of the base.

14. The LED light fixture of claim 13 wherein the least one closed channel is at least partially formed by the heat sink.

15. The LED light fixture of claim 14 wherein the heat sink includes parallel fins extending from the back surface, the least one elongate channel being formed along the fin(s).

16. The LED light fixture of claim 14 wherein the heat sink is an extrusion forming the at least one elongate closed wiring channel therealong.

17. The LED light fixture of claim 1 wherein the heat sink is an extrusion forming the at least one elongate closed wiring channel therealong.

18. The LED light fixture of claim 17 wherein the heat sink includes parallel fins extending from the back surface, the least one elongate channel being formed along the fin(s).

19. The LED light fixture of claim 1 wherein the housing includes a closed chamber enclosing at least one LED driver.

* * * * *

UNITED STATES PATENT AND TRADEMARK OFFICE

CERTIFICATE OF CORRECTION

PATENT NO. : 9,039,241 B2
APPLICATION NO. : 14/087971
DATED : May 26, 2015
INVENTOR(S) : Brian Kinnune et al.

It is certified that error appears in the above-identified patent and that said Letters Patent is hereby corrected as shown below:

ON THE TITLE PAGE
In Item (57) titled Abstract, line 1 delete “fixture a housing” and insert --fixture housing--.
IN THE SPECIFICATION
At column 3, line 57 after the word “heat-dissipating,” insert --section--.
At column 4, line 22 delete “surface” and insert --surfaces--.
At column 6, line 1 insert --an-- after the words “views of”.
At column 7, line 46 insert a --.-- between 122 and the word “Inner”.
At column 7, line 49 insert a --.-- between 142 and the word “Inner”.
At column 9, line 25 delete “cool-air” and insert --cool air--.
At column 9, line 28 insert --an-- after the word “is”.
At column 9, line 53 delete “of”.
IN THE CLAIMS
At column 10, line 29 in claim 7, insert --at-- before the words “least one”.
At column 10, line 33 in claim 8, insert --at-- before the words “least one”.
At column 10, line 47 in claim 14, insert --at-- before the words “least one”.
At column 10, line 50 in claim 15, insert --at-- before the words “least one”.
At column 10, line 59 in claim 18, insert --at-- before the words “least one”.

Signed and Sealed this
Second Day of February, 2016

Michelle K. Lee

Michelle K. Lee
*Director of the United States Patent and Trademark Office*